US006413332B1

(12) United States Patent
Ota et al.

(10) Patent No.: US 6,413,332 B1
(45) Date of Patent: Jul. 2, 2002

(54) METHOD OF PRODUCING FERRITIC CR-CONTAINING STEEL SHEET HAVING EXCELLENT DUCTILITY, FORMABILITY, AND ANTI-RIDGING PROPERTIES

(75) Inventors: Hiroki Ota; Yasushi Kato; Takumi Ujiro; Susumu Satoh, all of Chiba (JP)

(73) Assignee: Kawasaki Steel Corporation (JP)

( * ) Notice: Subject to any disclaimer, the term of this patent is extended or adjusted under 35 U.S.C. 154(b) by 0 days.

(21) Appl. No.: 09/650,052

(22) Filed: Aug. 29, 2000

(30) Foreign Application Priority Data

Sep. 9, 1999 (JP) ..... 11-255898
Nov. 2, 1999 (JP) ..... 11-312880
Nov. 15, 1999 (JP) ..... 11-324635

(51) Int. Cl.[7] ..... C21D 8/02

(52) U.S. Cl. ..... 148/610

(58) Field of Search ..... 148/610

(56) References Cited

U.S. PATENT DOCUMENTS 4,070,208 A * 1/1978 Hayami et al. ..... 148/610

* cited by examiner

*Primary Examiner*—Deborah Yee
(74) *Attorney, Agent, or Firm*—Schnader Harrison Segal & Lewis LLP

(57) ABSTRACT

Producing a ferritic Cr-containing steel sheet having excellent ductility, formability, and anti-ridging properties, and exhibiting excellent surface quality after forming, wherein a ferritic Cr-containing steel sheet contains, by mass %, about 0.001 to 0.12% of C, about 0.001 to 0.12% of N, and about 9 to 32% of Cr, and has a crystal grain structure in which in a section of a hot-rolled annealed steel sheet in the thickness direction parallel to the rolling direction, an elongation index of crystal grains is 5 or less at any position, and in a section of a cold-rolled annealed steel sheet in the thickness direction parallel to the rolling direction, any colony of coarse grains oriented in the rolling direction has an aspect ratio of 5 or less. The production method includes hot rolling, pre-rolling by cold or warm rolling with a rolling reduction of about 2 to 15%, hot-rolled sheet annealing, cold rolling, and finish annealing; preferably the FDT of hot rolling is 850° C., and 0.0002 to 0.0030% of B is added.

11 Claims, 7 Drawing Sheets

ELONGATION INDEX :
$e = L1/L2$

METHOD OF PRODUCING FERRITIC CR-CONTAINING STEEL SHEET HAVING EXCELLENT DUCTILITY, FORMABILITY, AND ANTI-RIDGING PROPERTIES

BACKGROUND OF THE INVENTION

1. Field of the Invention

The present invention relates to a ferritic Cr-containing steel sheet suitable for use for building facing materials, kitchen utensils, chemical plants, water tanks, automobile heat resistant members, etc. Particularly, the present invention relates to a ferritic Cr-containing steel sheet having excellent ductility, formability, and anti-ridging property, and a method of producing the same. In the present invention, the steel sheet includes a steel plate, and a steel strip.

2. Description of the Related Art

Stainless steel sheets have beautiful surfaces and excellent corrosion resistance, and are thus widely used for building facing materials, kitchen utensils, chemical plants, water tanks, etc. Particularly, austenitic stainless steel sheets have excellent ductility and excellent press-formability, and thus cause no ridging as a result of pressing, and are widely used for the above applications.

On the other hand, ferritic Cr-containing steel sheets such as ferritic stainless steel sheets need to be improved in formability. This is done by purifying the steel. The use for the above applications, instead of austenitic stainless steel, sheets of SUS 304, SUS 315, etc. have recently been studied. This is because the properties of the ferritic stainless steel are widely known, for example, low thermal expansion coefficient, low sensitivity to stress corrosion cracking, and low cost due to the absence of the expensive Ni ingredient.

However, for application to formed products, the ferritic stainless steel sheets have lower ductility than the austenitic stainless steel sheets, and this causes problems in that "ridging" occurs in the surfaces of the formed products. Ridging is an unevenness that spoils or downgrades the beauty of the formed products, significantly increasing the polishing load. Therefore, in order to further extend the application of ferritic stainless steel sheets, improvement in all of ductility, formability and anti-ridging properties are required.

For these requirements, ferritic stainless steel having excellent formability comprises 0.03 to 0.08 wt % of C, 0.01 wt % or less of Ni, and 2×N wt % to 0.2 wt % of Al and is proposed in, for example, Japanese Unexamined Patent Publication No. 52-24913. In the technique disclosed in Japanese Unexamined Patent Publication No. 52-24913, the C and N contents are decreased, and the Al content is twice or more as much as the N content decreasing the amount of solute nitrogen and making the crystal grains fine, thereby improving ductility, anti-ridging properties, and secondary formability.

However, in the technique disclosed in the aforesaid Publication No. 52-24913, the formability is greatly improved, but the anti-ridging properties are not significantly improved. Therefore, when working such as press forming or the like is performed, polishing is required for improving the beauty of the metal surface, increasing cost due to increased polishing load.

On the other hand, for example, Japanese Unexamined Patent Publication No. 51-123720 discloses a method for reducing ridging, in which after hot rolling, rolling is performed with a rolling reduction of 15% or more in a temperature region of 450 to 700° C., followed by annealing, cold rolling and final annealing.

Although the technique disclosed in the aforesaid Publication No. 51-123720 improves the anti-ridging properties, the technique does not significantly improve ductility or formability. Therefore, the various further attempts have been made to improve all of ductility, formability and anti-ridging properties concurrently.

Japanese Unexamined Patent Publication No. 2-170923 discloses a method of producing a chromium stainless steel sheet having excellent anti-ridging properties and press-formability, in which a hot-rolled sheet obtained by hot-rolling a chromium stainless steel containing 13.0 to 20.0 wt % of chromium is subjected to pre-cold rolling with a rolling reduction of 2 to 30%, followed by continuous annealing, descaling, cold rolling, and finish annealing. Strain is achieved by cold rolling before annealing to promote recrystallization in annealing, permitting continuous annealing for improving formability and anti-ridging properties.

The occurrence of ridging is a fundamental problem and is inherent in a ferritic stainless steel sheet. It needs to be fully resolved. On the other hand Japanese Unexamined Patent Publications Nos. 9-263900 and 10-330887 disclose a technique for improving anti-ridging properties by controlling a colony of similarly oriented crystal grains.

Although the technique disclosed in Japanese Unexamined Patent Publication No. 2-170923 improves the so-called "r" value (Lankford value) and the anti-ridging properties, the technique has a problem in that there is still considerable room for further improvement of both those properties, and that it fails to improve significantly the anti-ridging property and r value of the stainless steel.

Although the techniques disclosed in Japanese Unexamined Patent Publications Nos. 9-263900 and 10-330887 can prevent the occurrence of a colony of similarly oriented grains, they both face the problem that the occurrence of ridging cannot be completely suppressed, with the products exhibiting poor surface qualities after forming.

Furthermore, deeply drawing a ferritic stainless steel by press forming or the like encounters the problem of planar anisotropy of the "r" value and elongation of the steel sheet. Even when the steel sheet has a high mean "r" value and, a mean elongation value in each direction, with a low minimum "r" value and a minimum elongation value, deep drawing cannot be sufficiently performed. In the steel sheets produced by the above-described conventional techniques, the mean "r" value and mean elongation are improved, while the minimum "r" value and minimum elongation value are low enough to cause a problem of high planar anisotropy of the "r" value and the elongation value.

The above-described conventional techniques cannot produce a ferritic stainless steel sheet satisfying the need for better ductility, formability, and anti-ridging properties at low cost. Namely, in the conventional techniques, formability is greatly improved, while the effect of improving the anti-ridging property is insufficient. Therefore, in an application using working such as press forming or the like an increased polishing load is necessary for improving the surface beauty of the formed product. In addition, although the mean "r" value and mean elongation value are improved, the problem remains that sufficient formability cannot be obtained in actual press forming (or the like) because of the high planar anisotropy of the "r" value and elongation, thereby causing difficulties in producing steel having sufficient levels of ductility, formability and anti-ridging properties at low cost.

SUMMARY OF THE INVENTION

The present invention has been achieved for solving the problems associated with the above-described conventional techniques.

An object of the present invention is to provide a ferritic Cr-containing steel sheet having good ductility and formability, while also having excellent anti-ridging properties, particularly an anti-ridging property equivalent to that of stainless steel SUS304, and excellent surface qualities after forming, and a method of producing the same. Another object of the present invention is to provide a ferritic Cr-containing steel sheet having good ductility and formability, excellent anti-ridging properties, and low planar anisotropy of the "r" value, along with excellent elongation characteristics.

This invention also relates to a method of producing such a ferritic Cr-containing steel sheet.

We have discovered the importance of specific chemical components and proportions in the steel, and the steps of pre-rolling performed by warm or cold rolling with a relatively low rolling reduction between hot-rolling and hot-rolled sheet annealing to improve ductility, formability and the anti-ridging property. We have further found that in combination with these steps, about 0.0002 to 0.0030% of B can be added to significantly decrease the planar anisotropy of elongation of the steel. We have further found that the finishing delivery temperature FDT of the hot rolling step shall be set to a value as low as 850° C. or less, and that this increases the minimum "r" value $r_{min}$ and significantly improves the planar anisotropy of the "r" value, leading to the achievement of the remarkable qualities of the steel of the present invention.

In the present invention, the hot-rolled sheet annealing step may comprise either box annealing or continuous annealing. However, in continuous annealing, a stabilizing element such as Ti or Nb must be added to the steel in which the C and N contents are decreased, and B is added to the steel in amounts more fully described hereinafter.

In the present invention, as a result of studies of a basic solution of the fundamental ridging problem in a ferritic Cr-containing steel sheet, with special attention to the crystal grain structure of the steel sheet, it was found that the anti-ridging properties are significantly improved by decreasing the elongation index of the steel. This is defined as the ratio of the length of the crystal grains in the rolling direction to the length of the crystal grains in the thickness direction after hot-rolled sheet annealing. It was also found that the occurrence of ridging can be significantly suppressed by suppressing the formation of a colony comprising coarse crystal grains generally oriented in the rolling direction of the cold-rolled annealed steel sheet. This is an important achievement of the present invention.

The present invention provides a method of producing a ferritic Cr-containing steel sheet comprising the step of hot-rolling a steel raw material comprising about 0.001 to 0.12% of C, about 0.001 to 0.12% of N, and about 9 to 32% of Cr, all percentages herein being mass percentages. After the hot-rolled sheet annealing step, a cold-rolling step comprises cold-rolling the hot-rolled sheet passed through the hot-rolled sheet annealing step to form a cold-rolled sheet, followed by the finish annealing step.

In the method, a pre-rolling step is performed by cold or warm rolling at a rolling reduction of about 2 to 15% between the hot-rolling step and the hot-rolled sheet annealing step. In the present invention, the hot-rolled sheet annealing step uses a Cr-containing steel raw material comprising components appropriately controlled for box annealing or continuous annealing.

In box annealing, in the hot-rolled sheet annealing step, the hot-rolled sheet is preferably maintained at a predetermined annealing temperature for about 1 hour or more, and cooled to about 600° C. at a mean cooling rate of less than about 25° C./h after retention, and the annealing temperature is more preferably in the range between the about ($A_1$ transformation point+30)° C. to about 1000° C. In the practice of the present invention, in order to decrease the planar anisotropy of the "r" value, and the elongation, the finishing delivery temperature in the hot rolling step is preferably controlled at about 850° C. or less, and about 0.0002 to 0.0030% of B is preferably added.

The product of the present invention comprises a ferritic Cr-containing steel sheet having excellent ductility, formability and anti-ridging properties, and comprises, in mass %, about 0.001 to 0.12% of C, about 0.001 to 0.12% of N, and about 9 to 32% of Cr, and comprises a section of the steel sheet in the thickness direction parallel to the rolling direction, having an elongation index of crystal grains of about 5 or less at any position.

The present invention also provides a method of producing a ferritic Cr-containing cold-rolled annealed steel sheet having excellent ductility, formability, and anti-ridging properties, comprising the steps of cold rolling the steel sheet to the extent of about 30% or more, and finish annealing at about 700° C. or more.

The present invention further provides a ferritic Cr-containing steel sheet having excellent ductility, formability, and anti-ridging properties, and comprises, by mass %, about 0.001 to 0.12% of C, about 0.001 to 0.12% of N, and about 9 to 32% of Cr, wherein the steel sheet has a crystal grain structure in which in a section of the steel sheet in the thickness direction parallel to the rolling direction, a coarse grain colony of crystal grains having a crystal grain area larger than about 2×A0, which A0 designates the mean crystal grain area, and oriented in the rolling direction has an aspect ratio of about 5 or less.

DESCRIPTION OF THE PREFERRED EMBODIMENTS

The results of basic experiments performed by the inventors are first described.

The inventors first studied the influence of the addition of strain: to the steel between the hot rolling and hot-rolled sheet annealing.

A ferritic stainless hot-rolled steel sheet (hot-rolling finishing delivery temperature FDT: 950° C.) having a composition comprising 0.063 mass % C-0.033 mass % N-0.27 mass % Si-0.60 mass % Mn-16.3 mass % Cr-0.33 mass % Ni-0.001 mass % Al-0.061 mass % V was cold-rolled with a rolling reduction of 0 to 20%, annealed by retention at 860° C. for 8 hours and slow cooling to 600° C. at a mean cooling rate of 7.2° C./hr, cold-rolled so that the cumulative rolling reduction of the hot-rolled sheet after hot rolling was 75%, and then finish annealed by retention at 830° C. for 30 seconds to obtain a ferritic stainless steel sheet. The thus-obtained ferritic stainless cold-rolled steel sheet was examined with respect to mean elongation $El_{mean}$, mean "r" value (Lankford value) $r_{mean}$, and the ridging grade. The results are shown in FIG. 1.

Figure 1A:
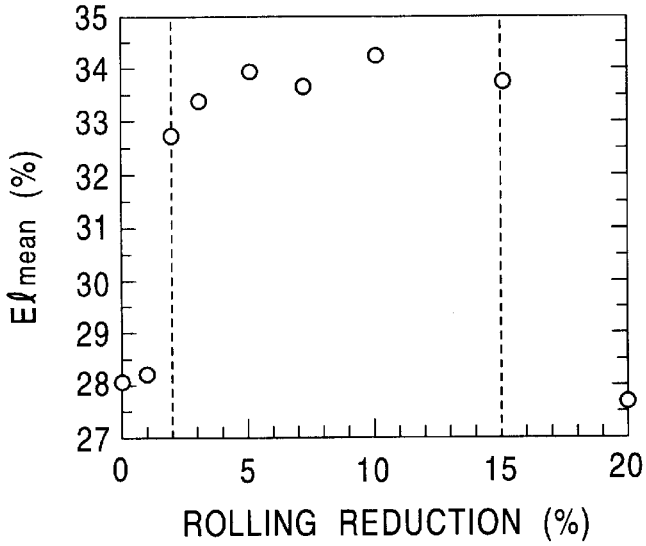
FIG. 1A is a graph showing the relation between the pre-rolling reduction and mean elongation $El_{mean}$ in a ferritic stainless hot-rolled steel sheet as hereinafter described in detail.
Figure 1B:
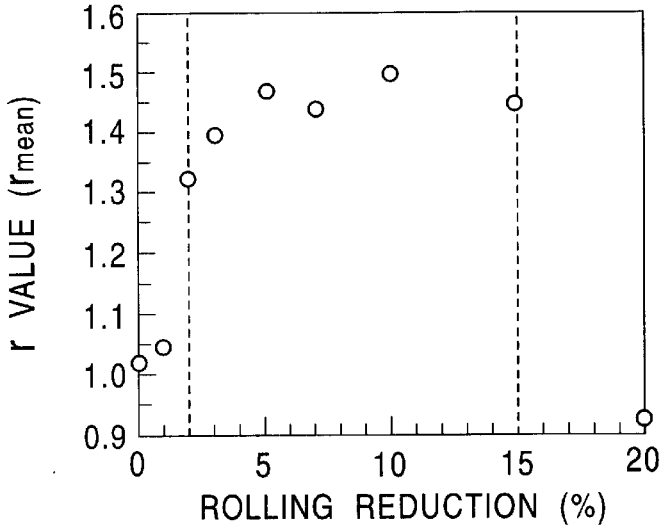
FIG. 1B is a graph showing the relation between pre-rolling reduction and mean "r" value $r_{mean}$ of the steel.
Figure 1C:
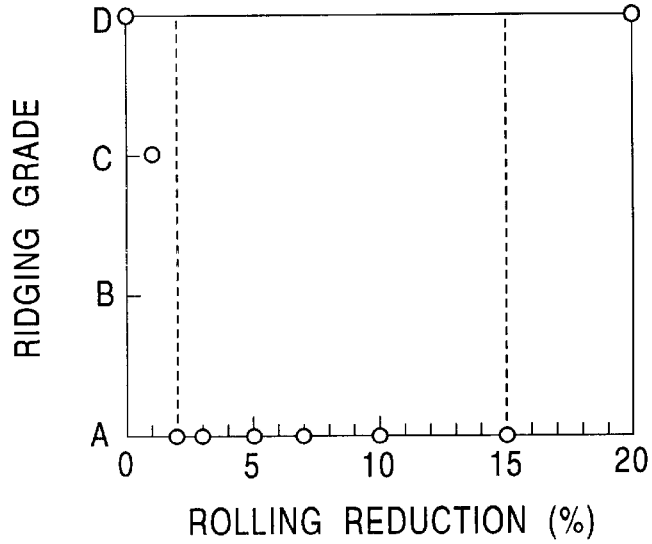
FIG. 1C is a graph showing the relation between the pre-rolling reduction and the ridging grade of the steel.

FIG. 1 indicates that by cold rolling with a rolling reduction of 2 to 15% before hot-rolled sheet annealing, a mean elongation $El_{mean}$ of 32% or more, a mean r value $r_{mean}$ of 1.3 or more, and the ridging grade A (ridging height of 5 $\mu$m or less) are obtained, and the elongation El, r value and the anti-ridging property are improved.

Such significant improvements in properties are believed to result from the addition of strain by pre-rolling before hot-rolled sheet annealing, and careful component control according to the hot-rolled sheet annealing conditions. Namely, in the case of box annealing in performing the hot-rolled sheet annealing step, Al among chemical components is controlled to about 0.03 mass % or less, and the hot-rolled sheet is annealed by retention at the annealing temperature for 1 hour or more and then slow cooling to obtain an effect. Although the mechanism of improving the properties is not completely clarified at present, it is believed to relate to the fact that the amount of solute nitrogen N is increased by decreasing the Al content, and the precipitation of carbonitride on dislocation during the heating step of annealing the hot-rolled sheet is accelerated by applying strain in thickness by pre-rolling to facilitate recrystallization. The annealing temperature is preferably about ($A_1$ transformation point+30)° C. or more. The $A_1$ transformation point is represented by the equation:

$$A_1 \text{ transformation point}=35(Cr+1.72Mo+2.09Si+4.86Nb+8.29V+1.77Ti+21.4Al+40B-7.14C-8.0N-3.28Ni-1.89Mn-0.51Cu)+310.$$

On the other hand, in the case of continuous annealing as the form of hot-rolled sheet annealing, a stabilizing element such as Ti or Nb, which forms carbonitride, must be added. The carbonitride which finely precipitates during hot rolling functions as a pinning site of dislocation introduced by pre-rolling to facilitate recrystallization in hot-rolled annealing. The coarse carbonitride particles precipitating during casting are believed to function as nuclei for recrystallization during annealing.

Next we studied the influence of the finishing temperature on the "r" value during hot rolling, for further improving formability.

A ferritic stainless steel raw material having a composition comprising, by mass %, 0.063% C–0.033% N–0.27% Si–0.60% Mn–16.3% Cr–0.33% Ni–0.001% Al–0.061% V was hot-rolled so that the finishing delivery temperature (FDT) was 700 to 1000° C. to form a hot-rolled sheet, cold-rolled with a rolling reduction of 10%, annealed by retention at 860° C. for 8 hours and then slow cooling to 600° C. at a mean cooling rate of 7.2 ° C./h, cold-rolled so that the cumulative rolling reduction of the hot-rolled sheet after hot rolling was 75%, and then finish annealed by retention at 830° C. for 30 seconds to obtain a ferritic stainless cold-rolled steel sheet.

The thus-obtained ferritic stainless cold-rolled steel sheet was examined with respect to the "r" value in each of (a) the rolling direction, (b) the direction angled at 45° with the rolling direction, and (c) the direction angled at 90° with the rolling direction to determine the mean "r" value ($r_{mean}$) and the minimum "r" value ($r_{min}$). The results are shown in FIG. 2.

Figure 2:
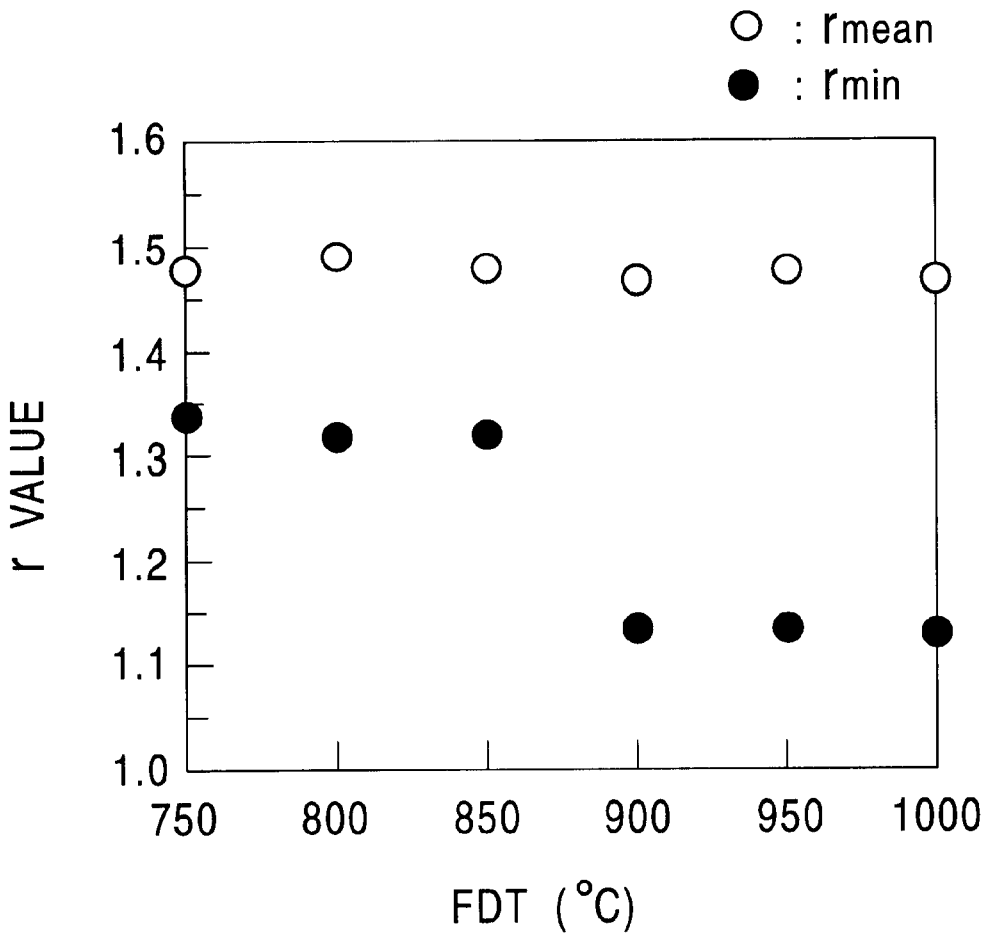
FIG. 2 is a graph showing, in a different steel, the relation between "r"$_{mean}$ and $r_{min}$, and the hot-rolling finishing delivery temperature FDT as described in detail hereinafter.

FIG. 2 indicates that at FDT of 850° C. or less, the "r" in value and the planar anisotropy are improved, and pressing formability is further, improved.

It was also found that by decreasing the elongation index of the crystal grains after hot-rolled sheet annealing over the :entire thickness, the anti-ridging properties of the steel after cold-rolled sheet annealing is significantly improved. It was further found that in the crystal grain structure after cold-rolled sheet annealing, the formation of colonies comprising coarse grains oriented in the rolling direction is suppressed to obtain good ductility and formability, and excellent anti-ridging properties, particularly, the excellent anti-ridging properties that are equivalent to those of SUS 304.

The limits of the chemical component s of a steel raw material suitable for the present invention are described. In the description below, "mass %" is abbreviated to "%".

In the present invention, assuming that hot-rolled sheet annealing is in the form of box annealing, a suitable steel raw material comprises about 0.01 to 0.12% of C, about 0.01 to 0.12% of N, about 11 to 18% of Cr, and Al controlled to about 0.03% or less, or about 0.005 to 0.12% of C, about 0.005 to 0.12% of N, about 0.0002 to 0.0030% of B, about 11 to 18% of Cr, and Al controlled to about 0.03% or less, and preferably further comprises one or two of Mo and Cu in a total of about 0.50 to 2.5%. The steel raw material may have a composition further comprising about 1:0% or less of Si, about 1.0% or less of Mn, about 1.0% or less of Ni, about 0.15% or less of V, about 0.05% or less of P, and about 0.01% or less of S, the balance comprising Fe, and incidental impurities.

On the other hand, assuming that hot-rolled sheet annealing is continuous annealing, a suitable steel raw material comprises about 0.001 to 0.02% of C, about 0.001 to 0.02% of N, about 9 to 32% of Cr, about 0.30% or less of Al, about 0.0002 to 0.0030% of B, and one or both of about 0.05 to 0.50% of Ti and about 0.05 to 0.50% of Nb, and preferably one or both of Mo and Cu in a total amount of about 0.50 to about 2.5%. The steel raw material may have a composition: further comprising about 1.0% or less of Si, about 1.0% or less of Mn, about 1.0% or less of Ni, about 0.15% or less of V, about 0.05% or less of P, and about 0.01% or less of S, the balance comprising Fe, and incidental impurities.

In some cases, the steel raw material further comprises at least one of Zr, Ta, Ca, and Mg according to demand.

The reasons for limiting the chemical components of the suitable steel raw material of the present invention are described below.

C: about 0.01 to 0.12% (box annealing), about 0.005 to 0.12% (B addition, box annealing), about 0.001 to 0.02% (continuous annealing)

In the present invention, assuming that hot-rolled sheet annealing is box annealing, the C content is preferably decreased as much as possible in order to improve ductility. However, with an excessively low C content, the anti-ridging property deteriorates to produce unevenness in a working portion during working such as press forming or the like, thereby deteriorating the beauty of a product. Therefore, in box annealing, the lower limit of the C content is set to about 0.01%, preferably set to about 0.02% or more. However, when about 0.0002 to 0.0030% of B is added, an effect can be obtained even at a C content lower limit of about 0.005%, and the lower limit is preferably about 0.01% or more. On the other hand, with an excessively high C content of over about 0.12%, the ductility deteriorates, and a Cr depleted zone, coarse precipitates, and inclusions as a starting point of rusting are increased. Therefore, the upper limit of the C content is set to about 0.12%, preferably set to about 0.10% or less.

Assuming that hot-rolled sheet annealing is continuous annealing, a decrease in the C content is effective to improve ductility. However, with an excessively low C content, the cost of steelmaking is increased. Therefore, the lower limit of the C content is set to about 0.001%. While with an excessively high C content of over about 0.02%, ductility deteriorates, and the Cr depleted zone, coarse precipitates, and inclusions as the starting point of rusting are increased. Therefore, the upper limit of the C content is set to about 0.02%, preferably set to about 0.001 to 0.015%.

N: about 0.01 to 0.12% (box annealing), about 0.005 to 0.12% (B addition, box annealing), about 0.001 to 0.02% (continuous annealing)

Assuming that hot-rolled sheet annealing is box annealing, like the C content, the N content is preferably decreased as much as possible for improving ductility. However, with an excessively low N content, the anti-ridging property deteriorates to produce unevenness in a working portion during working such as press forming or the like, thereby downgrading the beauty of a product. Therefore, in box annealing, the lower limit of the N content is set to about 0.01%, preferably set to about 0.02% or more. However, when about 0.0002 to 0.0030% of B is added, an effect can be obtained even at a N content lower limit of about 0.005%, and the lower limit is preferably about 0.01% or more. On the other hand, with an excessively high N content of over about 0.12%, the ductility decreases, and the Cr depleted zone, coarse precipitates, and inclusions as the starting point of rusting are increased. Therefore, the upper limit of the N content is set to about 0.12%, preferably set to about 0.10% or less.

Assuming that hot-rolled sheet annealing is continuous annealing, like the C content, a decrease in the N content is effective to improve ductility. However, with an excessively low N content, the cost of steel making is increased. Therefore, the lower limit of the N content is set to about 0.001%. While with an excessively high N content of over about 0.02%, ductility decreases, and the Cr depleted zone, coarse precipitates, and inclusions as the starting point of rusting are increased. Therefore, the upper limit of the N content is set to about 0.02%, preferably set to about 0.001 to 0.015%.

B: about 0.0002 to 0.0030%

B is an element for improving secondary formability, and with a B content in the range of about 0.0002 to 0.0030%, in addition to the effect of improving the secondary formability, the planar anisotropy of elongation is significantly improved without deteriorating the effect of improving elongation, the "r" value, and the anti-ridging property by pre-rolling.

Figure 3:
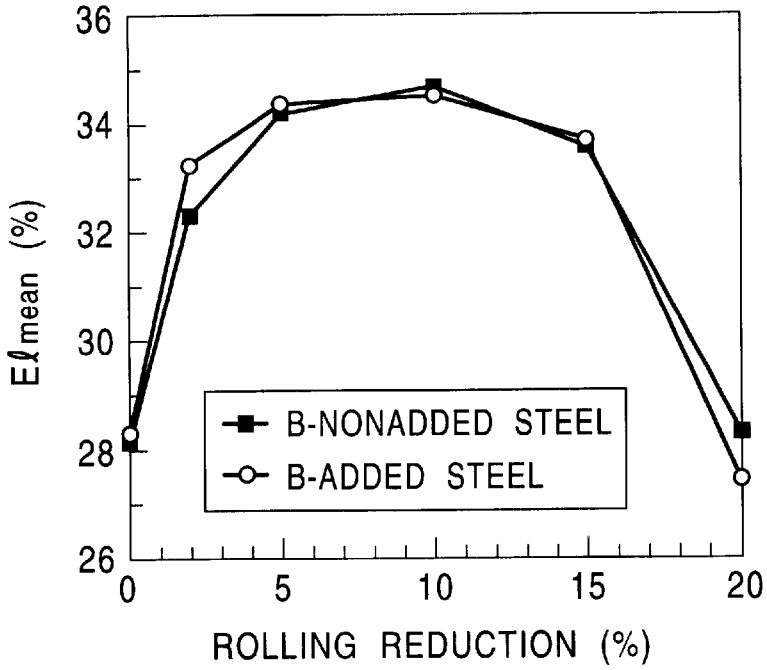
FIG. 3 is a graph of steels showing the influence of B addition on elongation of a finish annealed steel material.
Figure 4:
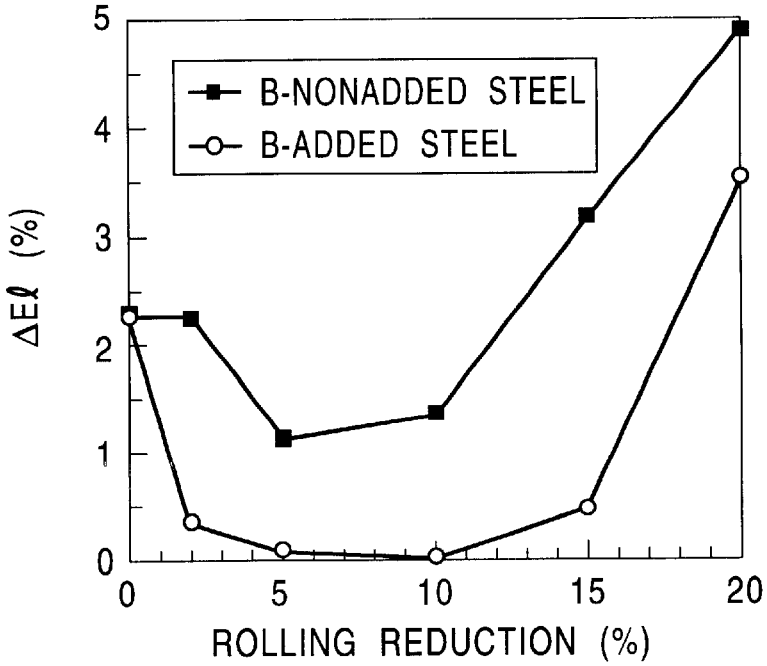
FIG. 4 is a graph of steels showing the influence of B addition and pre-rolling reduction on the planar anisotropy of elongation of a finish annealed steel material.

This point was first clarified by studies made by the inventors. FIGS. 3 and 4 show an example of the results of the studies. FIGS. 3 and 4 are graphs respectively showing the influences of the addition of B on the elongation and the planar anisotropy thereof of a material obtained by a method in which a hot-rolled steel sheet having each of the compositions shown in Table 1 was pre-rolled by 0 to 20% by cold rolling, annealed by retention at 860° C. for 8 hours, cold-rolled so that the cumulative rolling reduction including pre-rolling after hot rolling was 75%, and then finish annealed by retention at 830° C. for 30 seconds. These figures indicate that although elongation El is not influenced by the presence of B (FIG. 3), with a rolling reduction of 2 to 15%, the planar anisotropy ΔEl of elongation of B-nonadded steel is 1% or more, while the planar anisotropy ΔEl of B-added steel is as low as less than 0.5% (FIG. 4).

With a B content of less than 0.0002%, the effect of improving the planar anisotropy of elongation is not sufficient, while with a B content of over 0.0030%, the formability of a product decreases.

On the basis of this finding, the B content is limited to about 0.0002 to 0.0030%, preferably about 0.0002 to 0.0010%. Although the mechanism of improvement in the planar anisotropy of elongation due to the addition of B is not currently known, the improvement is believed to relate to the phenomenon that during hot-rolled sheet annealing, B combines with N in steel to produce fine precipitates on dislocation introduced by pre-rolling, thereby suppressing recovery of the dislocation and promoting recrystallization.

Cr: about 11 to 18% (box annealing), about 9 to 32% (continuous annealing)

Cr improves corrosion resistance. The preferred range depends upon other additive elements and production conditions. In box annealing as a form of hot-rolled sheet annealing, there is the problem of precipitating carbonitride due to the high C and N contents. Therefore, in order to impart corrosion resistance in various corrosive environments, a Cr content of at least about 11% is required. With a Cr content of over about 18%, formability deteriorates. Therefore, the Cr content is limited to about 11 to 18%, preferably about 13 to 18%.

On the other hand, in continuous annealing as a form of hot-rolled sheet annealing, a Cr content of at least about 9% is required for imparting the corrosion resistance in various corrosive environments. However, with a Cr content of over about 32%, formability deteriorates. Therefore, the Cr content is limited to about 9 to 32%, preferably about 11 to 30%.

Al: about 0.03% or less (box annealing), 0.30% or less (continuous annealing)

Al functions as a deoxidizer. A preferable range of the Al content depends upon the conditions of the hot-rolled sheet annealing. In box annealing as the form of hot-rolled sheet annealing, the amount of solute nitrogen is increased by decreasing the Al content to accelerate the precipitation of carbonitride on dislocation introduced by pre-rolling in the course of annealing. As a result, recrystallization in box annealing is promoted to improve the anti-ridging property. On the other hand, with a high Al content, an oxide inclusion is increased to cause many surface defects such as scabs or the like. Therefore, in box annealing, the Al content is controlled to about 0.03% or less, preferably about 0.01% or less.

On the other hand, in continuous annealing as a form of hot-rolled sheet annealing, Al has the same function as the added stabilizing element Ti or Nb which forms carbonitride. The fine carbonitride precipitation in hot rolling is believed to function as pinning sites of the dislocation introduced by pre-rolling to facilitate recrystallization during hot-rolled sheet annealing. The coarse carbonitride precipitating in casting is believed to function as nuclei of recrystallization during annealing. However, with a high Al content, the amount of an oxide inclusion is increased and causes surface defects such as scabs or the like. Therefore the Al content is about 0.30% or less, preferably about 0.20% or less.

Si: about 1.0% or less

Si functions as a deoxidizer. However, with a high Si content, ductility and cold formability deteriorate. Therefore, the Si content is preferably about 1.0% or less, more preferably about 0.03 to 0.50%.

Mn: about 1.0% or less

Mn is an element which combines with S to decrease the amount of solute S, and is thus effective to suppress grain boundary segregation of S, and prevent cracking during hot rolling. However, with an excessively high Mn content, cold formability and corrosion resistance deteriorate. Therefore, the Mn content is preferably limited to about 1.0% or less, more preferably about 0.05 to 0.8%.

Ni: about 1.0% or less

Ni improves corrosion resistance. However, with a high Ni content, cold formability deteriorates. The Ni content is preferably limited to about 1.0% or less even when Ni is added according to demand. From the viewpoint of formability, the Ni content is more preferably about 0.7% or less.

V: about 0.15% or less

V combines with C and N to form carbide and nitride, respectively, and prevents the coarsening of crystal grains. However, with a high V content, cold formability deteriorates. In the present invention, the V content is preferably limited to about 0.15% or less, more preferably about 0.10% or less, even when V is added according to demand.

P: about 0.05% or less

P deteriorates formability in hot rolling, and causes pitting, and thus the P content is preferably decreased as much as possible. Since the adverse effect of P is not significant up to a content of about 0.05%, a P content of up to about 0.05% is allowable. The P content is preferably about 0:.04% or less.

S: about 0.01,% or less

S is an element which forms a sulfide and deteriorate cleanness of steel and MnS functions as a starting point of rusting, and which causes grain boundary segregation to promote grain boundary embrittlement. Therefore, the S content is preferably decreased as much as possible. Since the adverse effect of S is not significant up to a content of about 0.01%, a S content of up to about 0.01% is allowable. The S content is preferably about 0.008% or less.

Mo, Cu: about 0.50 to 2.5% in total

Mo and Cu both improve corrosion resistance, and are effectively added when high corrosion resistance is required. However, with a total of less than 0.50%, the effect is insufficient, while with an excessive total content, formability deteriorates. Therefore, the total content of Mo and Cu is about 2.5% or less, preferably about 0.50 to 2.0%.

Zr, Ta: about 0.5% or less each Zr and Ta combine with C and N to decrease the amounts of solute C and N, respectively, present in ferrite, thereby improving ductility and formability. With the Zr and Ta contents of about 0.5% each, not only formability deteriorates, but also surface quality deteriorates. Therefore, each of the Zr and Ta contents is about 0.5% or less.

Ca: about 0.0005 to 0.010%

Ca has the function to decrease the melting point of an oxide inclusion to promote floating and separation of the inclusion in the steelmaking step, preventing the occurrence of surface defects due to the inclusion. However, with a Ca content of less than about 0.0005%, no effect is obtained, while with a Ca content of over about 0.010%, the surface quality deteriorates. Therefore, the Ca content is about 0.0005 to 0.010%, preferably about 0.0005 to 0.0050%.

Mg: about 0.0002 to 0.0050%

Mg has the effect of improving formability in hot rolling. However, with a Mg content of less than about 0.0002%, no effect is obtained, while with a Mg content of over about 0.0050%, surface quality is adversely affected. Therefore, the Mg content is about 0.0002 to 0.0050%, preferably about 0.0002 to 0.0030%.

One or two of about 0.05 to 0.50% of Ti, and about 0.05 to 0.50% of Nb

Both Ti and Nb are elements which combine with C and N to form carbide and nitride, or carbonitride, and decrease the amounts of solute C and N in ferrite, thereby improving ductility and formability. Both elements are also essential for continuous annealing as hot-rolled sheet annealing. The fine carbonitride precipitating in hot rolling possibly functions as pinning sites of the dislocation introduced by pre-rolling to facilitate recrystallization during hot-rolled sheet annealing. The coarse carbonitride precipitating in casting is believed to function as nuclei of recrystallization during annealing. However, with high contents of Ti and Nb, the amount of an oxide inclusion is increased to cause surface defects such as scabs or the like. Therefore, each of the contents of Ti and Nb is about 0.50% or less.

The method of producing a ferritic stainless steel sheet by using a steel raw material having the above-described composition will be described below.

Molten steel having the above composition is smelted in a conventional smelting furnace such as a converter, an electric furnace, or the like, refined by a known refining method such as vacuum degassing (RH method), VOD method, AOD method, or the like, and then cast by continuous casting or ingot making to form a slab or the like used as a steel raw material.

The steel raw material is then heated, and successively subjected to form a hot-rolled sheet, the pre-rolling step of rolling the hot-rolled sheet by cold or warm rolling to impart strain, the hot-rolled sheet annealing step of annealing the hot-rolled sheet passed through the pre-rolling step, the cold rolling step of cold-rolling the hot-rolled sheet passed through the hot-rolled sheet annealing step to form a cold-rolled sheet, and the finish annealing step of finish annealing the cold-rolled sheet. If required, descaling may be performed between hot rolling and pre-rolling, after hot-rolled sheet annealing, or after cold-rolled sheet annealing.

In the hot rolling step of the present invention, the hot rolling conditions are not limited as long as a hot-rolled sheet having a desired thickness can be obtained. When formability is required to be further improved, particularly the planar anisotropy of the "r" value is required to be improved, the finishing delivery temperature FDT of hot rolling is preferably about 850° C. or less. With a finishing delivery temperature of hot rolling of over about 850° C., the planar anisotropy of the "r" value is increased.

The thus-obtained hot-rolled sheet is descaled according to demand, and then subjected to the pre-rolling step before hot-rolled sheet annealing.

In the pre-rolling step, rolling with a rolling reduction of about 2 to 15% is performed by cold or warm rolling. This rolling introduces strain in thickness, and a combination with subsequent annealing improves the elongation, the "r" value, and the anti-ridging properties. With a rolling reduction of less than about 2%, the elongation, the "r" value, and the anti-ridging property are less improved, while with a rolling reduction of over about 15%, the elongation, the "r" value, and the anti-ridging properties deteriorate. Therefore, in the pre-rolling step, the rolling reduction is limited in the range of about 2 to 15%. In the pre-rolling step, rolling is performed by cold rolling or warm rolling at less than about 450° C. With a rolling temperature of about 450° C. or more, the strain in thickness introduced by rolling is recovered to decrease the effect of pre-rolling.

Pre-rolling may be advantageously performed between the completion of the hot rolling step and the hot-rolled sheet annealing step. For example, rolling may be performed under conditions wherein the coil is at temperature above room temperature during the time of cooling of the coil from less than 450° C. to room temperature after hot rolling.

The hot-rolled sheet subjected to pre-rolling is then annealed in the hot-rolled sheet annealing step. In the hot-rolled sheet annealing step, the annealing may be either box annealing or continuous annealing according to the components of the steel raw material.

In box annealing, although the heating rate up to a predetermined annealing temperature is not limited, the mean heating rate from about 500° C. up to the predetermined temperature is preferably about 50° C./hr or less. Box annealing is preferably high-temperature long-term retention annealing followed by gradual cooling comprising heating to the predetermined annealing temperature, retention at the annealing temperature for about 1 hour or more, and then slow cooling to about 600° C. at a mean cooling rate of about 25° C./hr or less after retention. In the present invention, the predetermined annealing temperature is in the range of about 700° C. or more, preferably about 750° C. or more, to less than about 1000° C. from the viewpoint of improvements in ductility and the anti-ridging property. The annealing temperature is more preferably about ($A_1$ transformation point+30)° C. to less than about 1000° C. This is possibly related to the phenomenon that at an annealing temperature not lower than the $A_1$ transformation point, a two-phase structure of (ferrite+austenite) is formed in the course of annealing to partially re-dissolve carbonitride, recrystallize and make equiaxed ferrite grains, and make random the crystal orientation accompanying transformation. On the other hand, at an annealing temperature of about 1000° C. or more, the crystal grains after hot-rolled sheet annealing and after cold-rolled sheet annealing are significantly coarsened to downgrade the anti-ridging property and surface quality due to the occurrence of significant amounts of "orange peel." In the present invention, effective box annealing for improving properties comprises retention at high temperature,and slow cooling for the precipitation of carbonitride and recovering of the Cr depleted zone. Furthermore, isothermal retention in the temperature range of about 600 to 850° C. may be performed in the course of slow cooling instead of slow cooling after retention.

In the present invention, the mean cooling rate (C.R.) down to about 600° C. after retention represents the value obtained by dividing the temperature drop AT from the retention temperature to about 600° C. by the time t required for the temperature drop.

Figure 5A:
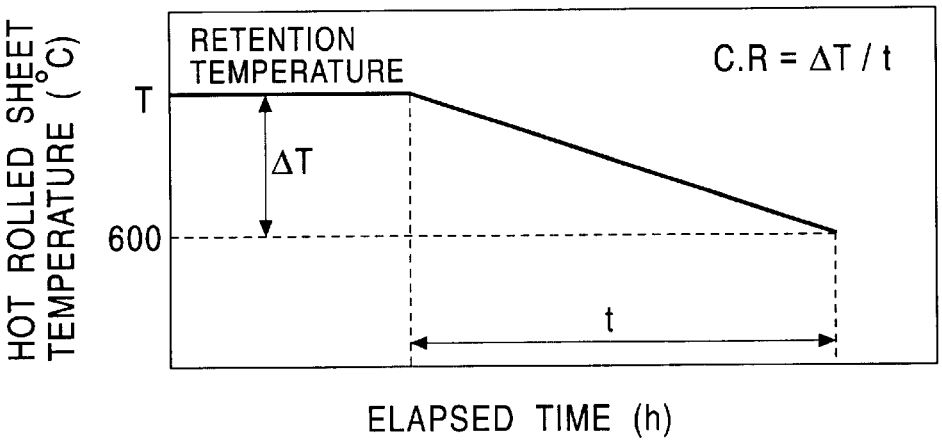
FIG. 5A is a schematic diagram showing an example of a cooling pattern during hot-rolled sheet steel annealing.
Figure 5B:
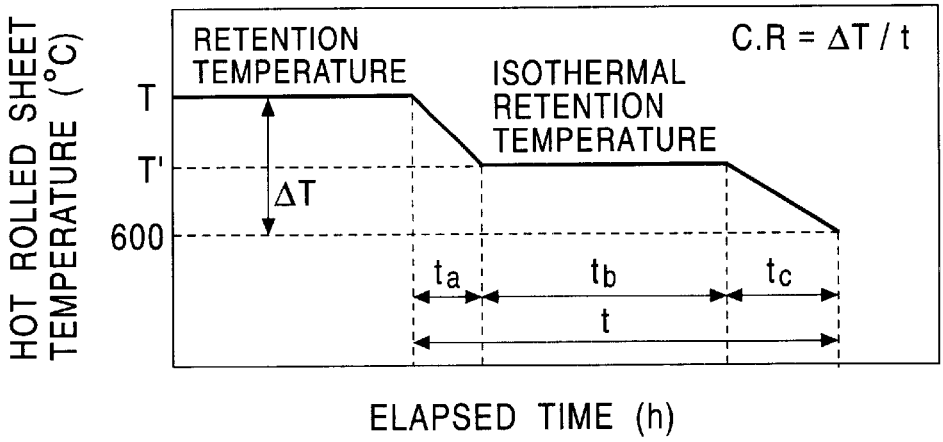
FIG. 5B is a schematic diagram showing an example of a cooling pattern used during hot-rolled sheet annealing.
Figure 5C:
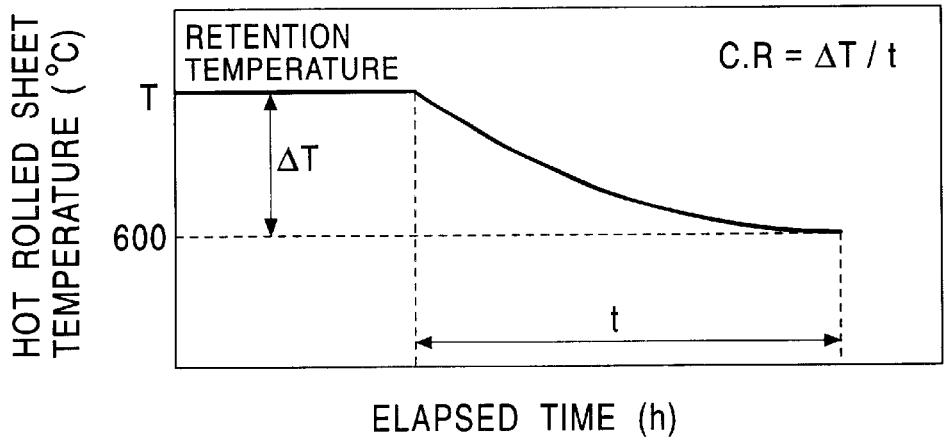
FIG. 5C is a schematic diagram showing an example of a cooling pattern used during hot-rolled sheet annealing.

As shown in FIG. 5, cooling patterns after hot-rolled sheet annealing are roughly divided into the linear pattern shown in FIG. 5A, the pattern shown in FIG. 5B in which isothermal retention is performed in the course of cooling, and the pattern shown in FIG. 5C in which the cooling rate slowly decreases. In consideration of the pattern shown in FIG. 5B, when T=860° C., T'=700° C., $t_a$=16 hr, $t_b$=10 hr, and $t_c$=10 hr, the mean cooling rate (C.R.) down to 600° C. after retention is 7.2° C./h.

In continuous annealing as hot-rolled sheet annealing, the annealing temperature is 700° C. or more, preferably in the range of 750° C. to 1100° C., from the viewpoint of improvements in ductility and the anti-ridging property.

The hot-rolled sheet passed through the hot-rolled sheet annealing step is descaled and then cold-rolled in the cold rolling step to obtain a cold-rolled sheet.

In the cold rolling step, the rolling reduction of cold rolling is preferably about 30% or more, more preferably about 50 to 95%. With a rolling reduction of less than about 30%, particularly the "r" value and the anti-ridging properties are significantly reduced in some cases.

In the finish annealing step after the cold rolling step, the cold-rolled sheet is finish annealed.

Finish annealing is preferably performed at a temperature of about 600° C. or more, which causes recrystallization, for improving formability. The finish annealing temperature is more preferably in the range of about 700 to 1100° C. From the viewpoint of productivity, finish annealing is preferably continuous annealing. In the present invention, the cold rolling step and the finish annealing step may be repeated at least twice. The repetition of the cold rolling step and the finish annealing step further improves the r value, ductility, and the anti-ridging property.

Of course, the cold-rolled sheet can be fished by 2D finishing, 2B finishing, BA finishing, etc. (Japanese Industrial Standard: JIS G4305, or ASTM A480/A480M) according to application.

Description will now be made of the reasons for limiting the crystal grain structure necessary for ferritic stainless steel having good ductility and formability, excellent anti-ridging property, particularly the anti-ridging property equivalent to SUS 304, and excellent surface quality after forming.

As a result of various studies of effective means for significantly improving the anti-ridging property with attention to the crystal grain size distribution of a steel sheet, we have found that it is very important to decrease the elongation index of crystal grains in the structure after hot-rolled sheet annealing, and prevent the occurrence of a colony of coarse grains oriented in the rolling direction and present in the cold-rolled annealed sheet.

Figure 6A:
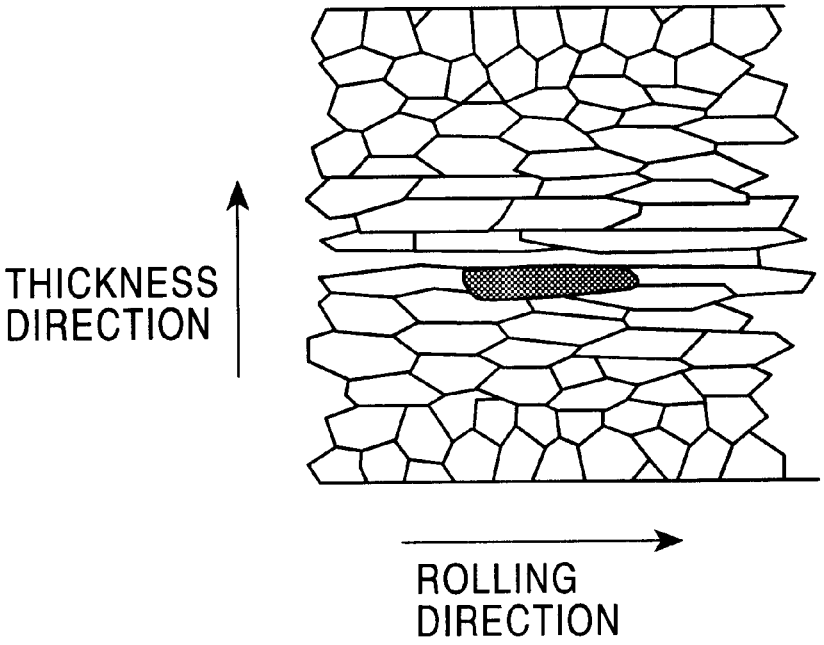
FIG. 6A is a schematic drawing showing the crystal grain structure of a section of a hot-rolled annealed sheet in the thickness direction parallel to the rolling direction.
Figure 6B:
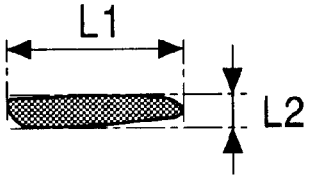
FIG. 6B is a schematic drawing showing a method of measuring an elongation index of crystal grains.
Figure 7:
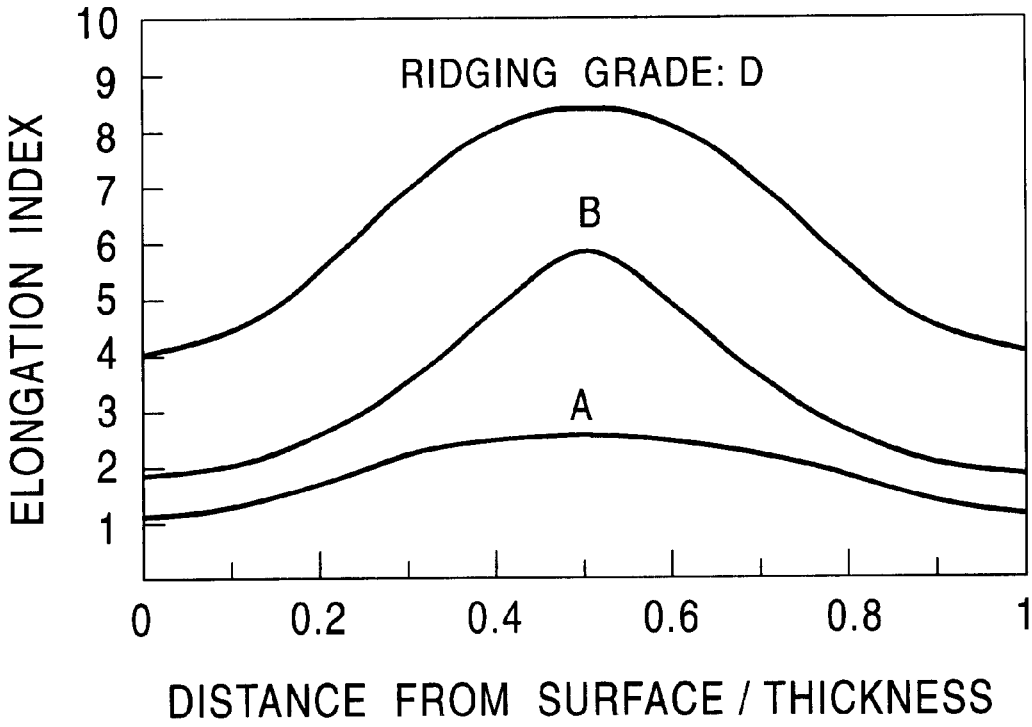
FIG. 7 is a graph showing the relation between the elongation index distribution of crystal grains of a hot-rolled annealed steel sheet and the ridging grade.

FIG. 6 is a schematic drawing showing the crystal grain structure of a section of a hot-rolled annealed sheet in the thickness direction parallel to the rolling direction. FIG. 7 shows the result of measurement of the elongation index (length in the rolling direction/length in the thickness direction) distribution of the crystal grains of each of steel sheets having ridging grades A, B, and D. Particularly, in the steel sheets having ridging grades B and D, the elongation index in the vicinity of the center is higher than that in the vicinity of the surface. The elongated grains are sufficiently recrystallized by conventional cold rolling and annealing to form equiaxed grains. However, the elongated grains present in the hot-rolled annealed sheet possibly promote the formation of a colony (group of similar oriented grains) or a colony of coarse grains (group of coarse grains oriented in the rolling direction), which is a cause of the occurrence of ridging in the cold-rolled annealed sheet, to cause deterioration in the anti-ridging property.

In the present invention, as a means for improving the anti-riding property by decreasing the elongated grains to decrease the colony of similar oriented grains and the colony of coarse grains, a draft of about 2 to 15% is applied to the hot-rolled sheet by cold rolling. The strain introduced by pre-rolling promotes recrystallization for making grains equiaxed to decrease the elongation index of crystal grains in the vicinity of the center of the sheet after hot-rolled sheet annealing. However, with a draft of over about 15%, the anti-ridging property rather deteriorates, and the crystal grains in the vicinity of the steel sheet surface are coarsened to cause the occurrence of "orange peel" in some cases.

In order to decrease the elongated grains to decrease the colony of similar oriented grains or the colony of coarse grains, the, crystal grains are preferably sufficiently made equiaxed by recrystallization during hot-rolled sheet annealing. Besides the method of the present invention, conceivable effective methods include the method of significantly decreasing the finishing delivery temperature in hot rolling to accumulate strain energy before annealing, and the method of hardening before hot-rolled sheet annealing to utilize strain accompanying transformation.

Figure 8A:
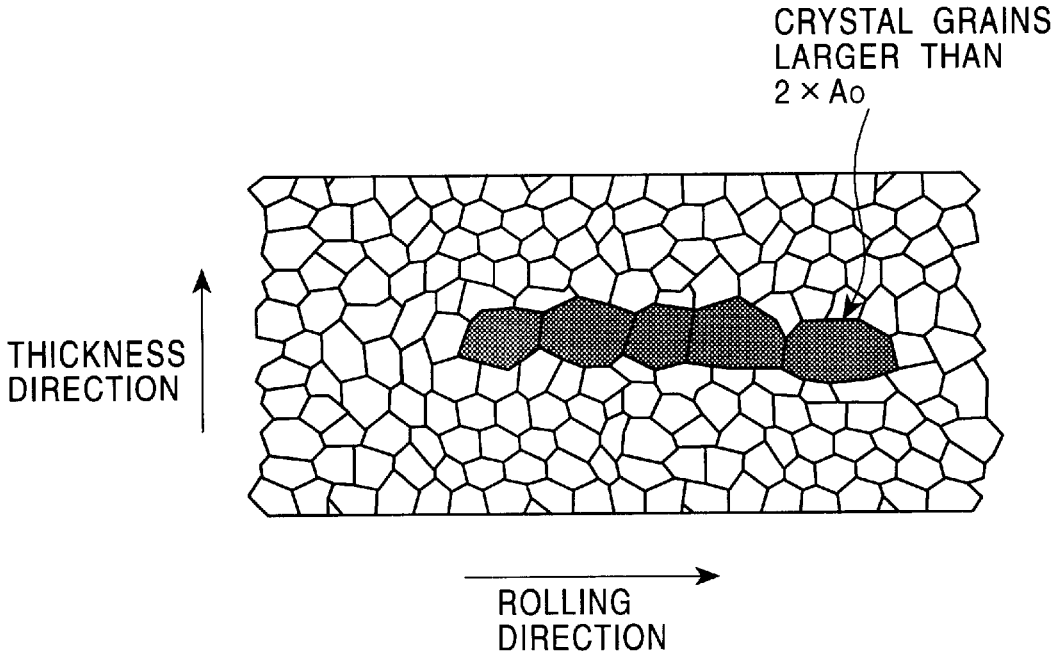
FIG. 8A is a schematic drawing showing a coarse grain colony in a section of a cold-rolled annealed steel sheet in the thickness direction parallel to the rolling direction.
Figure 8B:
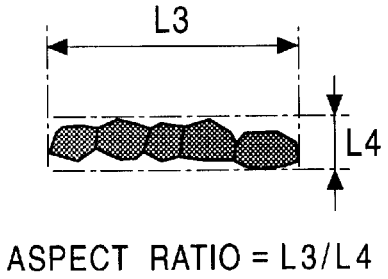
FIG. 8B is a schematic drawing showing a method of measuring the aspect ratio of a coarse grain colony in a steel sheet.

FIG. 8A is a schematic drawing showing a colony of coarse grains present in a cold-rolled annealed sheet. The term "coarse grains" means crystal grains having a crystal grain area larger than 2×A0 which A0 is the mean crystal grain area in a section of the steel sheet in the rolling direction. As a result of various studies, in order to achieve anti-ridging properties equivalent to SUS 304, it was found to be necessary that the aspect ratio of any colony of coarse grains oriented in the rolling direction is about 5 or less. Although the detailed mechanism of the occurrence of ridging due to the presence of the coarse grain colony is not completely known, the mechanism is possibly related to the facts (1) that the occurrence of ridging is peculiar to ferritic steel, (2) that in ferritic steel, a yield phenomenon occurs in a tensile test to cause inhomogeneous deformation referred to as "Lüders Band", and (3) that the yield stress depends upon the crystal grain size, and coarser grains yield with lower stress. Namely, with the coarse grain colony present, yield occurs in a small region in the initial stage of deformation, and influences deformation of the peripheral region, thereby possibly causing the occurrence of ridging in the surface of the steel sheet. By suppressing the formation of the coarse grain colony to obtain a homogeneous crystal grain structure, the anti-ridging property is significantly improved.

A resolution means for decreasing the coarse grain colony is to decrease the elongation index of the crystal grains in the hot-rolled sheet. Besides the method of the present invention, conceivable effective methods include the method of significantly decreasing the finishing delivery temperature in hot rolling to accumulate strain energy before annealing, and the method of hardening before hot-rolled sheet annealing to utilize strain accompanying transformation. It is also thought to be effective to repeat cold rolling and annealing at least twice after hot rolling.

Embodiment 1

Molten steel having each of the compositions shown in Table 2 (which follows in this specification) was smelted by a converter-secondary refining step, and continuously cast to form a slab. The thus-obtained slab was re-heated and then hot-rolled to obtain a hot-rolled sheet. The hot-rolled sheet was pickled, and successively subjected to the pre-rolling step, the hot-rolled sheet annealing step, the pickling step, the cold-rolling step, and the finish annealing step to form a cold-rolled annealed sheet having a thickness of 0.8 mm. The conditions of the pre-rolling step and the hot-rolled sheet annealing step are shown in Table 3. In the cold rolling step, the rolling reduction was controlled so that the cumulative rolling reduction of the hot-rolled sheet was 75%. In the finish annealing step, continuous annealing comprising retention at 830° C. for 30 seconds was performed.

Test pieces were collected from the thus-obtained cold-rolled annealed sheets, and subjected to a tensile test to measure the elongation El, the "r" value, and the ridging grade. The elongation El, the "r" value and the ridging grade were measured by the following methods:

(1) Elongation

In the central portion of the width direction in the steady state region of the cold-rolled annealed sheet at each of the front end and tail end thereof, three test pieces of JIS No. 13B (JIS Z 2201) were collected in each of the direction (the rolling direction, the direction at 45° to the rolling direction, and the direction at 90° to the rolling direction). The test pieces were subjected to tensile tests to measure the elongation El ($El_0$, $El_{45}$, or $El_{90}$) in each of the directions). The mean elongation $El_{mean}$ was determined from the elongation El in each of the directions by the following equation:

$$El_{mean}=(El_0+2El_{45}+El_{90})/4.$$

(wherein $El_0$ represents elongation in the rolling direction, $El_{45}$ represents elongation in the direction at 45° to the rolling direction, and $El_{90}$ represents elongation in the direction at 90° (perpendicular) to the rolling direction).

(2) "r" Value (Determined by JIS Z 2254:1996)

In the central portion of the width direction in the steady state region of the cold-rolled annealed sheet at each of the front end and tail end thereof, three test pieces of JIS No. 13B (JIS Z 2201) were collected in each of the directions (the rolling direction, the direction at 45° to the rolling direction, and the direction at 90° to the rolling direction). The strain in width and strain in thickness of each of the test pieces (width $W_0$, gauge length $L_0$=25 mm) were determined when a uniaxial tensile prestrain of 15% was applied to the test pieces. On the basis of the ratio of strain in width to strain in gauge length represented by the following equation, the "r" value in each of the directions was determined by JIS Z 2254:1996.

$$r=ln(W_0/W)/ln(LW/L_0W_0).$$

(wherein $W_0$ and $L_0$ respectively represent the width and gauge length of a test piece before the tensile test, and W and L respectively represent the width and gauge length after the tensile test).

The mean "r" value "$r_{mean}$" was determined by the following equation:

$$r_{mean}=(r_0+2r_{45}+r_{90})/4.$$

(wherein $r_0$ represents the "r" value in the rolling direction, $r_{45}$ represents the "r" value in the direction at 45° to the rolling direction, and $r_{90}$ represents the "r" value in the direction at 90° (perpendicular) to the rolling direction).

(3) Ridging Grade

In the central portion of the width direction in the steady state region of the cold-rolled annealed sheet at each of the front end and tail end thereof, two test pieces of JIS No. 5 (JIS Z 2201) were collected in the rolling direction. One side of each of the test pieces was finished and polished with #600(JIS R 6252:1999) abrasive paper. Then, uniaxial tensile prestrain was applied to each of the test pieces, and the ridging height of the central portion of each of the test pieces was measured by a roughness gauge. On the basis of the ridging height, the degree of ridging was evaluated.

The degree of ridging was evaluated on the basis of four grades including grade A of 5 $\mu$m or less, grade B of more than 5 to 10 $\mu$m, grade C of more than 10 to 20 $\mu$m, and grade D of more than 20 $\mu$m. With grades A and B based on these criteria, the anti-ridging property in press forming is excellent.

The results obtained are shown in Table 4.

In all examples of the present invention, $El_{mean}$ was 32% or more, $r_{mean}$ value was 1.30 or more, and the ridging grade was A, and thus all of the elongation, "r" value and anti-ridging properties were satisfactory. On the other hand, comparative examples were outside the range of the present invention, where there was a significant decrease of any of the elongation, r value and anti-ridging properties.

Embodiment 2

Molten steel having each of the compositions shown in Table 5 was smelted by a converter-secondary refining step, and cast by continuous casting to form a slab. The thus-obtained slab was re-heated, and then hot-rolled by hot rolling at each of the finishing delivery temperatures shown in Table 6 to obtain a hot-rolled sheet having a thickness of 3.2 to 4.0 mm. The hot-rolled sheet was pickled and successively subjected to the pre-rolling step, the hot-rolled sheet annealing step, the pickling step, the cold-rolling step, and the finish rolling annealing step to form a cold-rolled annealed sheet having a thickness of 0.8 mm. The conditions of the pre-rolling step and the hot-rolled sheet annealing step are shown in Table 6. The annealing was box annealing at 800 to 860° C. for 8 hours. In the cold rolling step, the rolling reduction was controlled to obtain a cold-rolled sheet having a thickness of 0.8 mm. The cumulative rolling reduction of the hot-rolled sheet was 75 to 80%. In the finish annealing step, continuous annealing comprising retention at 830° C. for 30 seconds was performed.

Test pieces were collected from the thus-obtained cold-rolled annealed sheets, and subjected to a tensile test to measure the elongation El, the "r" value, and the ridging grade. The elongation El, the "r" value and the ridging grade were measured by the same methods as Embodiment 1. The minimum of $r_0$, $r_{45}$ and $r_{90}$ was considered as $r_{min}$.

The results obtained are shown in Table 7.

All examples of the present invention exhibited values of $El_{mean}$ of 32% or more, an $r_{mean}$ value of 1.30 or more, and the ridging grade A, and thus had good elongation, r value and anti-ridging properties. Furthermore, the minimum "r" value $r_{min}$ was as high as 1.00 or more, and thus the planar anisotropy of r value was advantageously low.

On the other hand, in the comparative examples, which are outside the range of the present invention, the anti-ridging properties significantly deteriorated.

Embodiment 3

Molten steel having each of the compositions shown in Table 8 was smelted by a converter-secondary refining step, and continuously cast to form a slab. The thus-obtained slab was re-heated, and then hot-rolled by hot rolling at each of the finishing delivery temperatures shown in Table 9 to obtain a hot-rolled sheet having a thickness of 3.2 to 5.0 mm. The hot-rolled sheet was pickled, and successively subjected to the pre-rolling step, the hot-rolled sheet annealing step, the pickling step, the cold-rolling step, and the finish annealing step to form a cold-rolled annealed sheet having a thickness of 0.8 mm. The conditions of the pre-rolling step and the hot-rolled sheet annealing step are shown in Table 9. The annealing was box annealing at 880 to 1000° C. for 2 to 8 hours. In the cold rolling step, the rolling reduction was controlled to obtain a cold-rolled sheet having a thickness of 0.8 mm. The cumulative rolling reduction of the hot-rolled sheet was 75 to 84%. In the finish annealing step, continuous annealing comprising retention at 830° C. for 30 seconds was performed.

Test pieces were collected from the thus-obtained cold-rolled annealed sheets, and subjected to a tensile test to measure the elongation El, the r value, and the ridging grade. The elongation El, the r value and the ridging grade were measured by the same methods as Embodiments 1 and 2.

The results obtained are shown in Table 10.

All examples of the present invention exhibited $El_{mean}$ values of 34% or more, an $r_{mean}$ value of 1.40 or more, and the ridging grade A, and thus had good elongation, r value and anti-ridging property.

On the other hand, in the comparative examples outside the range of the present invention, the anti-ridging properties deteriorated.

Embodiment 4

Molten steel having each of the compositions shown in Table 11 was smelted by a converter-secondary refining step, and continuously cast to form a slab. The thus-obtained slab was re-heated, and then hot-rolled at each of the finishing delivery temperatures shown in Table 12 to obtain a hot-rolled sheet having a thickness of 3.2 mm. The hot-rolled sheet was pickled, and successively subjected to the pre-rolling step, the hot-rolled sheet annealing step, the pickling step, the cold-rolling step, and the finish rolling annealing step to form a cold-rolled annealed sheet having a thickness of 0.8 mm. The conditions of the pre-rolling step and the hot-rolled sheet annealing step are shown in Table 12. The sheet annealing was box annealing at 830 to 860° C. for 8 hours. In the cold rolling step, the rolling reduction was controlled to obtain a cold-rolled sheet having a thickness of 0.8 mm. The cumulative rolling reduction of the hot-rolled sheet was 75%. In the finish annealing step, continuous annealing comprising retention at 830° C. for 30 seconds was performed.

Test pieces were collected from the thus-obtained cold-rolled annealed sheets, and subjected to a tensile test to measure the elongation El, the "r" value, and the ridging grade. The elongation El, the "r" value and the ridging grade were measured by the same methods as Embodiments 1, 2 and 3.

Furthermore, the planar anisotropy ($\Delta$El) of elongation, which is an important item in the present invention, was determined by the following equation:

$$\Delta El=|El_0-2El_{45}+El_{90}|/2.$$

The results obtained are shown in Table 12.

All examples of the present invention exhibited $El_{mean}$ of 34% or more, a $r_{mean}$ value of 1.40 or more, and the ridging grade A, and thus had good elongation, "r" value and anti-ridging properties. Furthermore, in the examples of the present invention, the planar anisotropy of elongation $\Delta$El was significantly improved to 0.5% or less, while in the comparative examples, the planar anisotropy of elongation $\Delta$El was 2% or more.

On the other hand, in the comparative examples outside the scope of the present invention, any one of the elongation, the "r" value, and the anti-ridging properties deteriorated, and the planar isotropy of elongation ΔEl was too bad.

Embodiment 5

Molten steel having each of the compositions shown in Table 13 was smelted by the converter-secondary refining step, and cast continuously to form a slab. The thus-obtained slab was re-heated, and then hot-rolled by the hot rolling step to obtain a hot-rolled sheet having a thickness of 3.2 mm. The hot-rolled sheet was pickled, and successively subjected to the pre-rolling step, the hot-rolled sheet annealing step, the pickling step, the cold-rolling step, and the finish annealing step to form a cold-rolled annealed sheet having a thickness of 0.8 mm. The conditions of the pre-rolling step and the hot-rolled sheet annealing step are shown in Table 14. The hot-rolled sheet annealing was continuous annealing comprising retention at 900 to 1050° C. for 1 to 2 minutes. In the cold rolling step, the rolling reduction was controlled to obtain a cold-rolled sheet having a thickness of 0.8 mm. The cumulative rolling reduction of the hot-rolled sheet was 75%. In the finish annealing step, continuous annealing comprising retention at 900 to 1050° C. for 1 minute was performed.

Test pieces were collected from the thus-obtained cold-rolled annealed sheets, and subjected to a tensile test to measure the elongation El, the "r" value, and the ridging grade. The elongation El, the "r" value and the ridging grade were measured by the same methods as Embodiments 1, 2, 3 and 4.

The results obtained are shown in Table 14.

All examples of the present invention exhibited values of $El_{mean}$ of 34% or more, an "r"$_{mean}$ value of 1.40 or more, and the ridging grade A, and thus had good elongation, "r" value and anti-ridging properties. Furthermore, in the examples of the present invention, the planar anisotropy of elongation ΔEl was significantly improved to 0.5% or less, while in the comparative examples, the planar anisotropy of elongation ΔEl was 2% or more.

On the other hand, in the comparative examples outside the range of the present invention, at least one of the elongation, the "r" value, and the anti-ridging properties deteriorated, and the planar isotropy of elongation ΔEl was too bad.

Embodiment 6

Molten steel having each of the compositions shown in Table 15 was smelted by a converter-secondary refining step, and cast by the continuous casting method to form a slab. The thus-obtained slab was re-heated, and then hot-rolled by hot rolling at each of the finishing delivery temperatures shown in Table 16 to obtain a hot-rolled sheet having a thickness of 3.2 to 4.0 mm. The hot-rolled sheet was pickled, and successively subjected to the pre-rolling step, the hot-rolled sheet annealing step, the pickling step, the cold-rolling step, and the finish annealing step to form a cold-rolled annealed sheet having a thickness of 0.8 mm. The conditions of the pre-rolling step and the hot-rolled sheet annealing step are shown in Table 16. The hot-rolled sheet annealing was box annealing at 800 to 930° C. for 2 to 8 hours. In the cold rolling step, the rolling reduction was controlled to obtain a cold-rolled sheet having a thickness of 0.8 mm. The cumulative rolling reduction of the hot-rolled sheet was 75 to 80%. In the finish annealing step, continuous annealing comprising retention at 830° C. for 30 seconds was performed.

Test pieces were collected from the thus-obtained cold-rolled annealed sheets, and subjected to a tensile test to measure the elongation El, the "r" value, and the ridging grade. The elongation El, the "r" value and the ridging grade were measured by the same methods as Embodiment 1.

Furthermore, a section of each of the hot-rolled annealed sheets in the thickness direction parallel to the rolling direction was polished, etched with aqua regia, and then photographed in the range of thickness ×2 mm by an optical microscope with a magnification of ×100. In the resultant photograph of the structure, the maximum value of the elongation index of crystal grains was measured by image Processing. In addition, a section of each of the cold-rolled annealed sheets in the thickness direction parallel to the rolling direction was polished, etched with aqua regia, and then photographed in the range of thickness×1 mm by an optical microscope with a magnification of×200. In the resultant photograph of the structure, the mean crystal grain area A0, and the maximum aspect ratio of a coarse grain colony of crystal grains having a crystal grain area larger than 2×A0 were measured by image processing.

The results obtained are shown in Table 17.

All examples of the present invention exhibited good elongation, "r" value and anti-ridging property, while in comparative examples, all the elongation, the r value and the anti-ridging properties deteriorated.

Embodiment 7

Molten steel having each of the compositions shown in Table 18 was smelted by a converter-secondary refining step, and cast by the continuous casting method to form a slab. The thus-obtained slab was re-heated, and then hot-rolled by the hot rolling step to obtain a hot-rolled sheet having a thickness of 3.2 to 4.0 mm. The hot-rolled sheet was pickled, and successively subjected to the pre-rolling step, the hot-rolled sheet annealing step, the pickling step, the cold-rolling step, and the finish annealing step to form a cold-rolled annealed sheet having a thickness of 0.8 mm. The conditions of the pre-rolling step and the hot-rolled sheet annealing step are shown in Table 19. The hot-rolled sheet annealing was continuous annealing comprising retention at 900 to 1000° C. for 1 minute. In the cold rolling step, the rolling reduction was controlled to obtain a cold-rolled sheet having a thickness of 0.8 mm. The cumulative rolling reduction of the hot-rolled sheet was 75 to 80%. In the finish annealing step, continuous annealing comprising retention at 900 to 1000° C. for 1 minute was performed.

Test pieces were collected from the thus-obtained cold-rolled annealed sheets, and each subjected to a tensile test to measure the elongation El, the "r" value, and the ridging grade. The elongation El, the "r" value and the ridging grade were measured by the same methods as Embodiment 1.

Furthermore, a section of each of the hot-rolled annealed sheets in the thickness direction parallel to the rolling direction was polished, etched with aqua regia, and then photographed in the range of thickness×2 mm by an optical microscope with a magnification of ×100. In the resultant photograph of the structure, the maximum value of the elongation index of crystal grains was measured by image processing. In addition, a section of each of the cold-rolled annealed sheets in the thickness direction parallel to the rolling direction was polished, etched with aqua regia, and then photographed in the range of thickness×1 mm by an optical microscope with a magnification of ×200. In the resultant photograph of the structure, the mean crystal grain area A0, and the maximum aspect ratio of a coarse grain colony of crystal grains having a crystal grain area larger than 2×A0 were measured by image processing.

The results obtained are shown in Table 20.

All examples of the present invention exhibited good elongation, "r" value and anti-ridging property, while in comparative examples, all the elongation, the "r" value and the anti-ridging properties deteriorated.

The present invention can provide a ferritic Cr-containing steel sheet having excellent ductility, formability and anti-ridging property, or further having low planar anisotropy of the "r" value and elongation, and excellent press formability, at low cost, and thus the present invention exhibits a significant and advantageous industrial effect.

TABLE 1

| | (mass %) | | | | | | | | |
|---|---|---|---|---|---|---|---|---|---|
| | C | Si | Mn | P | S | Cr | N | Al | B |
| B-added steel | 0.056 | 0.32 | 0.65 | 0.030 | 0.006 | 16.2 | 0.0329 | 0.002 | 0.0002 |
| B-nonadded steel | 0.057 | 0.32 | 0.65 | 0.032 | 0.007 | 16.1 | 0.0315 | 0.003 | <0.0001 |

TABLE 2

| Steel | Chemical component (mass %) | | | | | | | | | |
|---|---|---|---|---|---|---|---|---|---|---|
| No. | C | N | Si | Mn | P | S | Al | Cr | Ni | V |
| A | 0.063 | 0.033 | 0.27 | 0.60 | 0.030 | 0.006 | 0.001 | 16.3 | 0.33 | 0.061 |
| B | 0.040 | 0.047 | 0.29 | 0.51 | 0.023 | 0.007 | 0.001 | 16.1 | 0.25 | 0.055 |
| C | 0.057 | 0.026 | 0.28 | 0.66 | 0.042 | 0.006 | 0.002 | 16.0 | 0.31 | 0.094 |
| D | 0.051 | 0.044 | 0.31 | 0.55 | 0.034 | 0.005 | 0.002 | 17.7 | 0.20 | 0.031 |
| E | 0.045 | 0.029 | 0.33 | 0.58 | 0.044 | 0.008 | 0.005 | 16.4 | 0.52 | 0.044 |
| F | 0.041 | 0.041 | 0.30 | 0.60 | 0.035 | 0.007 | 0.001 | 16.6 | 0.33 | 0.050 |
| G | 0.055 | 0.026 | 0.28 | 0.57 | 0.041 | 0.006 | 0.004 | 16.1 | 0.40 | 0.022 |
| H | 0.070 | 0.024 | 0.27 | 0.54 | 0.046 | 0.009 | 0.006 | 16.3 | 0.38 | 0.076 |
| I | 0.085 | 0.045 | 0.25 | 0.54 | 0.042 | 0.008 | 0.005 | 18.0 | 0.55 | 0.148 |
| J | 0.024 | 0.055 | 0.35 | 0.70 | 0.025 | 0.005 | 0.002 | 16.4 | 0.55 | 0.012 |
| K | 0.022 | 0.029 | 0.25 | 0.35 | 0.026 | 0.006 | 0.002 | 13.2 | 0.07 | 0.062 |
| L | 0.125 | 0.031 | 0.28 | 0.61 | 0.031 | 0.008 | 0.004 | 16.2 | 0.35 | 0.052 |
| M | 0.060 | 0.031 | 0.30 | 0.55 | 0.033 | 0.006 | 0.035 | 16.3 | 0.30 | 0.052 |
| N | 0.030 | 0.125 | 0.29 | 0.57 | 0.034 | 0.007 | 0.002 | 17.2 | 0.29 | 0.071 |

TABLE 3

| | | Production Condition | | | | | | |
|---|---|---|---|---|---|---|---|---|
| | | Pre-rolling condition | | Hot-rolled sheet annealing condition | | | | |
| Steel sheet No. | Steel No. | Rolling temperature ° C. | Rolling reduction % | Heating rate * ° C./h | Retention temperature ° C. | Retention time h | Cooling rate ** ° C./h | Isothermal retention *** temperature · time ° C. × h |
| 1 | A | — | — | 12 | 860 | 8 | 7.2 | 700° C. × 10 h |
| 2 | | RT | 1 | 12 | 860 | 8 | 7.2 | 700° C. × 10 h |
| 3 | | RT | 2 | 12 | 860 | 8 | 7.2 | 700° C. × 10 h |
| 4 | | RT | 3 | 12 | 860 | 8 | 7.2 | 700° C. × 10 h |
| 5 | | RT | 5 | 12 | 860 | 8 | 7.2 | 700° C. × 10 h |
| 6 | | 400 | 7 | 12 | 860 | 8 | 7.2 | 700° C. × 10 h |
| 7 | | RT | 10 | 12 | 860 | 8 | 7.2 | 700° C. × 10 h |
| 8 | | RT | 15 | 12 | 860 | 8 | 7.2 | 700° C. × 10 h |
| 9 | | RT | 20 | 12 | 860 | 8 | 7.2 | 700° C. × 10 h |
| 10 | B | RT | 0.5 | 10 | 830 | 8 | 7.2 | 700° C. × 10 h |
| 11 | | RT | 5 | 10 | 830 | 8 | 7.2 | 700° C. × 10 h |
| 12 | | RT | 10 | 10 | 830 | 8 | 7.2 | 700° C. × 10 h |
| 13 | C | RT | 2.5 | 5 | 800 | 8 | 5.5 | 700° C. × 10 h |
| 14 | | RT | 5 | 10 | 800 | 8 | 5.5 | 700° C. × 10 h |
| 15 | D | RT | 1 | 12 | 860 | 8 | 7.2 | 700° C. × 10 h |
| 16 | | RT | 7 | 12 | 860 | 8 | 7.2 | 700° C. × 10 h |
| 17 | E | RT | 5 | 20 | 860 | 8 | 7.2 | — |
| 18 | | RT | 18 | 20 | 860 | 8 | 7.2 | — |
| 19 | F | RT | 1.2 | 12 | 860 | 8 | 25 | — |
| 20 | | RT | 10 | 12 | 860 | 8 | 25 | — |
| 21 | G | RT | 0.5 | 12 | 860 | 1 | 6 | 800° C. × 6 h |
| 22 | | RT | 4 | 12 | 860 | 1 | 6 | 800° C. × 6 h |
| 23 | H | — | — | 12 | 860 | 8 | 7.2 | 600° C. × 10 h |
| 24 | | RT | 5 | 12 | 860 | 8 | 7.2 | 600° C. × 10 h |
| 25 | I | RT | 1 | 15 | 950 | 8 | 10 | 850° C. × 4 h |
| 26 | | RT | 4 | 15 | 950 | 8 | 10 | 850° C. × 4 h |

TABLE 3-continued

| Steel sheet No. | Steel No. | Production Condition: Pre-rolling condition: Rolling temperature ° C. | Rolling reduction % | Hot-rolled sheet annealing condition: Heating rate * ° C./h | Retention temperature ° C. | Retention time h | Cooling rate ** ° C./h | Isothermal retention *** temperature · time ° C. × h |
|---|---|---|---|---|---|---|---|---|
| 27 | J | RT | 2 | 50 | 750 | 8 | 4 | — |
| 28 | | RT | 10 | 50 | 750 | 8 | 4 | — |
| 29 | K | RT | 1 | 12 | 860 | 8 | 7.2 | 700° C. × 10 h |
| 30 | | RT | 7 | 12 | 860 | 8 | 7.2 | 700° C. × 10 h |
| 31 | L | — | — | 12 | 860 | 8 | 7.2 | 700° C. × 10 h |
| 32 | | RT | 5 | 12 | 860 | 8 | 7.2 | 700° C. × 10 h |
| 33 | M | RT | 5 | 12 | 860 | 8 | 7.2 | 700° C. × 10 h |
| 34 | N | RT | 3 | 12 | 860 | 8 | 7.2 | 700° C. × 10 h |
| 35 | A | RT | 2 | 860 × 30 s Continuous annealing | | | | |

* Heating rate between 500° C. and the retention temperature.
** Mean cooling rate between the retention temperature and 600° C.
*** Isothermal retention in the course of cooling.
RT: Room Temp.

TABLE 4

| Steel sheet No. | Steel No. | Test Result: Elongation $El_{mean}$ % | r value $r_{mean}$ | Ridging grade | Remarks |
|---|---|---|---|---|---|
| 1 | A | 28.2 | 1.02 | D | Comparative Example |
| 2 | | 28.3 | 1.05 | C | Comparative Example |
| 3 | | 32.8 | 1.33 | A | Example of this invention |
| 4 | | 33.4 | 1.40 | A | Example of this invention |
| 5 | | 34.0 | 1.47 | A | Example of this invention |
| 6 | | 33.7 | 1.44 | A | Example of this invention |
| 7 | | 34.3 | 1.50 | A | Example of this invention |
| 8 | | 33.8 | 1.45 | A | Example of this invention |
| 9 | | 27.8 | 0.92 | C | Comparative Example |
| 10 | B | 28.5 | 1.04 | D | Comparative Example |
| 11 | | 34.1 | 1.41 | A | Example of this invention |
| 12 | | 34.7 | 1.45 | A | Example of this invention |
| 13 | C | 33.1 | 1.35 | A | Example of this invention |
| 14 | | 34.2 | 1.42 | A | Example of this invention |
| 15 | D | 27.7 | 0.96 | D | Comparative Example |
| 16 | | 33.8 | 1.41 | A | Example of this invention |
| 17 | E | 33.6 | 1.38 | A | Example of this invention |
| 18 | | 26.9 | 0.91 | C | Comparative Example |
| 19 | F | 28.2 | 1.00 | D | Comparative Example |
| 20 | | 34.0 | 1.38 | A | Example of this invention |

TABLE 4-continued

| Steel sheet No. | Steel No. | Test Result: Elongation $El_{mean}$ % | r value $r_{mean}$ | Ridging grade | Remarks |
|---|---|---|---|---|---|
| 21 | G | 27.9 | 1.03 | D | Comparative Example |
| 22 | | 34.4 | 1.42 | A | Example of this invention |
| 23 | H | 26.8 | 0.94 | D | Comparative Example |
| 24 | | 32.5 | 1.34 | A | Example of this invention |
| 25 | I | 26.9 | 0.93 | C | Comparative Example |
| 26 | | 32.2 | 1.33 | A | Example of this invention |
| 27 | J | 32.6 | 1.36 | A | Example of this invention |
| 28 | | 34.2 | 1.44 | A | Example of this invention |
| 29 | K | 28.6 | 1.03 | C | Comparative Example |
| 30 | | 34.4 | 1.45 | A | Example of this invention |
| 31 | L | 25.3 | 0.86 | D | Comparative Example |
| 32 | | 24.4 | 0.84 | D | Comparative Example |
| 33 | M | 29.7 | 1.35 | C | Comparative Example |
| 34 | N | 23.4 | 0.83 | D | Comparative Example |
| 35 | A | 31.2 | 1.26 | A | Comparative Example |

TABLE 5

| Steel No. | Chemical component (mass %): C | N | Si | Mn | P | S | Al | Cr | Ni | V | Others |
|---|---|---|---|---|---|---|---|---|---|---|---|
| A | 0.063 | 0.033 | 0.27 | 0.60 | 0.030 | 0.006 | 0.001 | 16.3 | 0.33 | 0.061 | — |
| B | 0.040 | 0.047 | 0.29 | 0.51 | 0.023 | 0.007 | 0.001 | 16.1 | 0.25 | 0.055 | — |

TABLE 5-continued

| Steel | Chemical component (mass %) | | | | | | | | | | |
|---|---|---|---|---|---|---|---|---|---|---|---|
| No. | C | N | Si | Mn | P | S | Al | Cr | Ni | V | Others |
| I | 0.085 | 0.045 | 0.25 | 0.54 | 0.042 | 0.008 | 0.005 | 18.0 | 0.55 | 0.148 | — |
| J | 0.024 | 0.055 | 0.35 | 0.70 | 0.025 | 0.005 | 0.002 | 16.4 | 0.55 | 0.012 | — |
| L | 0.125 | 0.031 | 0.28 | 0.61 | 0.031 | 0.008 | 0.004 | 16.2 | 0.35 | 0.052 | — |
| M | 0.060 | 0.031 | 0.30 | 0.55 | 0.033 | 0.006 | 0.035 | 16.3 | 0.30 | 0.052 | — |
| N | 0.030 | 0.125 | 0.29 | 0.57 | 0.034 | 0.007 | 0.002 | 17.2 | 0.29 | 0.071 | — |
| O | 0.050 | 0.044 | 0.31 | 0.55 | 0.034 | 0.005 | 0.002 | 17.8 | 0.20 | 0.031 | B: 0.0005 |
| P | 0.022 | 0.028 | 0.25 | 0.35 | 0.025 | 0.006 | 0.002 | 13.2 | 0.07 | 0.062 | Mg: 0.0003 |
| Q | 0.062 | 0.030 | 0.25 | 0.56 | 0.045 | 0.006 | 0.001 | 16.1 | 0.66 | 0.012 | — |
| T | 0.020 | 0.030 | 0.30 | 0.36 | 0.023 | 0.005 | 0.001 | 11.4 | 0.06 | 0.035 | Mo: 0.7 |
| U | 0.023 | 0.014 | 0.28 | 0.35 | 0.028 | 0.005 | 0.001 | 13.0 | 0.05 | 0.040 | Cu: 0.5 |

TABLE 6

| | | Hot rolling | | Production Condition | | | | | |
|---|---|---|---|---|---|---|---|---|---|
| | | | | Pre-rolling condition | | Hot-rolled sheet annealing condition | | | |
| Steel sheet No. | Steel No. | Finishing delivery temperature ° C. | Thickness of hot-rolled sheet mm | Rolling temperature ° C. | Rolling reduction % | Heating rate * ° C./h | Retention temperature ° C. | Retention time h | Cooling rate ** ° C./h |
| 1 | A | 1000 | 3.2 | RT | 10 | 12 | 860 | 8 | 7.2 |
| 2 | | 830 | 3.2 | RT | 5 | 12 | 860 | 8 | 7.2 |
| 3 | | 750 | 3.2 | RT | 5 | 12 | 860 | 8 | 7.2 |
| 4 | B | 800 | 3.2 | RT | 5 | 12 | 860 | 8 | 7.2 |
| 5 | I | 1000 | 4.0 | RT | 4 | 12 | 860 | 8 | 7.2 |
| 6 | | 750 | 4.0 | RT | 4 | 12 | 860 | 8 | 7.2 |
| 7 | J | 1000 | 3.2 | RT | 5 | 10 | 800 | 8 | 5.5 |
| 8 | | 800 | 3.2 | RT | 5 | 10 | 800 | 8 | 5.5 |
| 9 | L | 850 | 3.2 | RT | 4 | 12 | 860 | 8 | 7.2 |
| 10 | M | 800 | 3.2 | RT | 5 | 5 | 860 | 8 | 7.2 |
| 11 | N | 850 | 3.2 | RT | 3 | 12 | 860 | 8 | 7.2 |
| 12 | O | 1000 | 4.0 | RT | 7 | 12 | 860 | 8 | 7.2 |
| 13 | | 800 | 4.0 | RT | 7 | 12 | 860 | 8 | 7.2 |
| 14 | | 800 | 4.0 | RT | 15 | 50 | 860 | 8 | 4.0 |
| 15 | P | 850 | 3.2 | RT | 7 | 5 | 860 | 8 | 25 |
| 16 | Q | 800 | 3.2 | RT | 5 | 10 | 800 | 8 | 5.5 |
| 17 | T | 850 | 4.0 | RT | 6 | 10 | 800 | 8 | 5.5 |
| 18 | U | 850 | 4.0 | RT | 6 | 12 | 860 | 8 | 7.2 |

* Heating rate between 500° C. and the retention temperature.
** Mean cooling rate between the retention temperature and 600° C.
RT: Room Temp.

TABLE 7

| Steel | | Test Result | | | | |
|---|---|---|---|---|---|---|
| sheet | Steel | Elongation | r value | | Ridging | |
| No. | No. | $El_{mean}$ % | $r_{mean}$ | $r_{min}$ | grade | Remarks |
| 1 | A | 34.0 | 1.47 | 1.08 | A | Example of this invention |
| 2 | | 34.0 | 1.47 | 1.32 | A | Example of this invention |
| 3 | | 34.2 | 1.48 | 1.34 | A | Example of this invention |
| 4 | B | 34.2 | 1.42 | 1.28 | A | Example of this invention |
| 5 | I | 32.1 | 1.32 | 0.91 | A | Example of this invention |
| 6 | | 32.5 | 1.35 | 1.23 | A | Example of this invention |
| 7 | J | 33.7 | 1.39 | 1.01 | A | Example of this invention |

TABLE 7-continued

| Steel | | Test Result | | | | |
|---|---|---|---|---|---|---|
| sheet | Steel | Elongation | r value | | Ridging | |
| No. | No. | $El_{mean}$ % | $r_{mean}$ | $r_{min}$ | grade | Remarks |
| 8 | | 33.8 | 1.42 | 1.27 | A | Example of this invention |
| 9 | L | 24.5 | 0.85 | 0.62 | D | Comparative Example |
| 10 | M | 29.6 | 1.35 | 1.20 | C | Comparative Example |
| 11 | N | 23.5 | 0.83 | 0.62 | D | Comparative Example |
| 12 | O | 33.8 | 1.41 | 1.00 | A | Example of this invention |
| 13 | | 33.9 | 1.43 | 1.30 | A | Example of this invention |
| 14 | | 34.0 | 1.45 | 1.31 | A | Example of this invention |

TABLE 7-continued

| Steel sheet No. | Steel No. | Test Result: Elongation $El_{mean}$ % | r value $r_{mean}$ | r value $r_{min}$ | Ridging grade | Remarks |
|---|---|---|---|---|---|---|
| 15 | P | 34.5 | 1.45 | 1.32 | A | Example of this invention |
| 16 | Q | 34.2 | 1.46 | 1.33 | A | Example of this invention |
| 17 | T | 34.3 | 1.44 | 1.31 | A | Example of this invention |
| 18 | U | 34.1 | 1.45 | 1.33 | A | Example of this invention |

TABLE 8

| Steel No. | Chemical component (mass %): C | N | Si | Mn | P | S | Al | Cr | Ni | V | Others | $A_1$ (° C.) |
|---|---|---|---|---|---|---|---|---|---|---|---|---|
| A | 0.063 | 0.033 | 0.27 | 0.60 | 0.030 | 0.006 | 0.001 | 16.3 | 0.33 | 0.061 | — | 816 |
| D | 0.051 | 0.044 | 0.31 | 0.55 | 0.034 | 0.005 | 0.002 | 17.7 | 0.20 | 0.031 | — | 878 |
| O | 0.050 | 0.044 | 0.31 | 0.55 | 0.034 | 0.005 | 0.002 | 17.8 | 0.20 | 0.031 | B: 0.0005 | 889 |
| R | 0.036 | 0.055 | 0.23 | 0.25 | 0.021 | 0.004 | 0.001 | 16.2 | 0.11 | 0.047 | — | 855 |
| S | 0.041 | 0.051 | 0.26 | 0.44 | 0.027 | 0.005 | 0.001 | 16.4 | 0.15 | 0.066 | — | 852 |

TABLE 9

| Steel sheet No. | Steel No. | Hot rolling: Finishing delivery temperature ° C. | Thickness of hot-rolled sheet mm | Production Condition: Pre-rolling condition: Rolling temperature ° C. | Rolling reduction % | Hot-rolled sheet annealing condition: Heating rate * ° C./h | Retention temperature ° C. | Retention time h | Cooling rate ** ° C./h |
|---|---|---|---|---|---|---|---|---|---|
| 1 | A | 900 | 3.2 | RT | 6 | 13 | 880 | 8 | 7.8 |
| 2 | A | 900 | 3.2 | RT | 6 | 13 | 900 | 8 | 8.3 |
| 3 | D | 950 | 4.0 | RT | 10 | 15 | 940 | 8 | 10 |
| 4 | D | 950 | 4.0 | RT | 10 | 14 | 910 | 8 | 7.0 |
| 5 | O | 1000 | 4.0 | RT | 3 | 12 | 920 | 5 | 8.8 |
| 6 | O | 1000 | 4.0 | RT | 8 | 12 | 920 | 8 | 8.8 |
| 7 | R | 750 | 4.0 | RT | 7 | 14 | 930 | 2 | 10 |
| 8 | R | 900 | 4.0 | RT | 7 | 13 | 885 | 8 | 7.9 |
| 9 | S | 800 | 5.0 | RT | 5 | 10 | 890 | 6 | 10 |
| 10 | S | 1000 | 5.0 | RT | 5 | 14 | 920 | 8 | 8.9 |
| 11 | S | 1000 | 5.0 | RT | 5 | 16 | 1000 | 6 | 11 |

* Heating rate between 500° C. and the retention temperature.
** Mean cooling rate between the retention temperature and 600° C.
RT: Room Temp.

TABLE 10

| Steel sheet No. | Steel No. | Test Result: Elongation $El_{mean}$ % | r value $r_{mean}$ | r value $r_{min}$ | Ridging grade | Remarks |
|---|---|---|---|---|---|---|
| 1 | A | 34.8 | 1.48 | 1.20 | A | Example of this invention |
| 2 | A | 35.2 | 1.50 | 1.24 | A | Example of this invention |
| 3 | D | 34.9 | 1.47 | 1.27 | A | Example of this invention |

TABLE 10-continued

| Steel sheet No. | Steel No. | Test Result: Elongation $El_{mean}$ % | r value $r_{mean}$ | r value $r_{min}$ | Ridging grade | Remarks |
|---|---|---|---|---|---|---|
| 4 | D | 35.1 | 1.47 | 1.15 | A | Example of this invention |
| 5 | O | 34.4 | 1.47 | 1.16 | A | Example of this invention |
| 6 | O | 34.6 | 1.49 | 1.22 | A | Example of this invention |
| 7 | R | 35.4 | 1.49 | 1.34 | A | Example of this invention |
| 8 | R | 34.6 | 1.46 | 1.21 | A | Example of this invention |
| 9 | S | 34.8 | 1.47 | 1.33 | A | Example of this invention |
| 10 | S | 35.3 | 1.48 | 1.26 | A | Example of this invention |
| 11 | S | 34.9 | 1.41 | 1.05 | C | Comparative |

TABLE 10-continued

| Steel sheet No. | Steel No. | Test Result: Elongation $El_{mean}$ % | r value: $r_{mean}$ | r value: $r_{min}$ | Ridging grade | Remarks |
|---|---|---|---|---|---|---|
| | | | | | | Example |

TABLE 11

| Steel | C | Si | Mn | P | S | Cr | N | Al | B |
|---|---|---|---|---|---|---|---|---|---|
| | (mass %) | | | | | | | | |
| a | 0.012 | 0.20 | 0.68 | 0.030 | 0.006 | 11.2 | 0.0070 | 0.010 | 0.0002 |
| b | 0.010 | 0.30 | 0.60 | 0.025 | 0.007 | 14.8 | 0.0080 | 0.002 | 0.0003 |
| c | 0.056 | 0.32 | 0.65 | 0.030 | 0.006 | 16.2 | 0.0329 | 0.001 | 0.0002 |
| d | 0.060 | 0.30 | 0.64 | 0.035 | 0.007 | 16.2 | 0.0315 | 0.002 | 0.0033 |
| e | 0.105 | 0.25 | 0.54 | 0.031 | 0.010 | 16.4 | 0.0205 | 0.001 | 0.0002 |
| f | 0.045 | 0.95 | 0.30 | 0.050 | 0.006 | 16.0 | 0.0501 | 0.001 | 0.0003 |
| g | 0.020 | 0.32 | 0.60 | 0.033 | 0.007 | 16.2 | 0.0960 | 0.001 | 0.0003 |
| h | 0.047 | 0.20 | 0.96 | 0.033 | 0.006 | 16.3 | 0.0440 | 0.002 | 0.0004 |

TABLE 12

| No. | Steel | Cold rolling reduction before annealing of hot-rolled sheet (%) | Box annealing condition for hot-rolled sheet | Finish annealing condition | $El_{mean}$ (%) | ΔEl (%) | $r_{mean}$ value | Ridging grade | Remarks |
|---|---|---|---|---|---|---|---|---|---|
| 1 | a | 1.0 | 830° C., 8 h | 830° C., 1 min | 29.7 | 2.41 | 1.19 | D | Comparative Example |
| 2 | a | 6 | 830° C., 8 h | 830° C., 1 min | 34.9 | 0.15 | 1.44 | A | Example |
| 3 | b | 0.8 | 830° C., 8 h | 830° C., 1 min | 30.0 | 2.29 | 1.20 | D | Comparative Example |
| 4 | b | 2.5 | 830° C., 8 h | 830° C., 1 min | 35.0 | 0.08 | 1.47 | B | Example |
| 5 | c | 0 | 860° C., 8 h | 830° C., 1 min | 28.3 | 2.25 | 1.03 | C | Comparative Example |
| 6 | c | 2 | 860° C., 8 h | 830° C., 1 min | 33.1 | 0.40 | 1.34 | A | Example |
| 7 | c | 5 | 860° C., 8 h | 830° C., 1 min | 34.2 | 0.12 | 1.48 | A | Example |
| 8 | c | 10 | 860° C., 8 h | 830° C., 1 min | 34.2 | 0.05 | 1.45 | A | Example |
| 9 | c | 15 | 860° C., 8 h | 830° C., 1 min | 33.6 | 0.49 | 1.46 | A | Example |
| 10 | c | 20 | 860° C., 8 h | 830° C., 1 min | 27.4 | 3.50 | 0.90 | D | Comparative Example |
| 11 | d | 5 | 860° C., 8 h | 830° C., 1 min | 26.6 | 3.44 | 0.91 | C | Comparative Example |
| 12 | e | 5 | 860° C., 8 h | 830° C., 1 min | 31.4 | 0.13 | 1.32 | A | Example |
| 13 | e | 1.0 | 860° C., 8 h | 830° C., 1 min | 27.0 | 2.33 | 1.01 | C | Comparative Example |
| 14 | f | 7.5 | 860° C., 8 h | 830° C., 1 min | 31.2 | 0.17 | 1.40 | A | Example |
| 15 | f | 1.0 | 860° C., 8 h | 830° C., 1 min | 25.5 | 2.55 | 0.86 | D | Comparative Example |
| 16 | g | 4 | 860° C., 8 h | 830° C., 1 min | 31.6 | 0.15 | 1.33 | A | Example |
| 17 | g | 0.5 | 860° C., 8 h | 830° C., 1 min | 27.1 | 2.82 | 1.02 | C | Comparative Example |
| 18 | h | 6.5 | 860° C., 8 h | 830° C., 1 min | 31.4 | 0.22 | 1.36 | A | Example |
| 19 | h | 0.5 | 860° C., 8 h | 830° C., 1 min | 25.7 | 2.04 | 0.88 | C | Comparative Example |

TABLE 13

| Steel | C | Si | Mn | P | S | Cr | N | Al | Mo | Ti | Nb | Cu | B |
|---|---|---|---|---|---|---|---|---|---|---|---|---|---|
| | (mass %) | | | | | | | | | | | | |
| i | 0.008 | 0.15 | 0.30 | 0.030 | 0.006 | 17.0 | 0.0076 | 0.002 | — | — | 0.30 | — | 0.0005 |
| j | 0.009 | 0.26 | 0.46 | 0.030 | 0.006 | 16.1 | 0.0077 | 0.001 | — | — | 0.31 | 0.50 | 0.0006 |
| k | 0.008 | 0.06 | 0.15 | 0.033 | 0.005 | 17.8 | 0.0080 | 0.025 | 1.21 | 0.26 | — | — | 0.0010 |
| l | 0.006 | 0.25 | 0.45 | 0.028 | 0.001 | 18.3 | 0.0085 | 0.002 | 1.90 | — | 0.27 | — | 0.0003 |
| m | 0.003 | 0.20 | 0.09 | 0.018 | 0.005 | 30.0 | 0.0070 | 0.104 | 1.85 | — | 0.14 | — | 0.0002 |
| n | 0.009 | 0.37 | 0.25 | 0.027 | 0.003 | 11.3 | 0.0089 | 0.045 | — | 0.31 | — | — | 0.0003 |

TABLE 14

| No. | Steel | Cold rolling reduction before annealing of hot-rolled sheet (%) | Continuous annealing condition for hot-rolled sheet | Finish annealing condition | $El_{mean}$ (%) | ΔEl (%) | $r_{mean}$ value | Ridging grade | Remarks |
|---|---|---|---|---|---|---|---|---|---|
| 1 | i | 1.0 | 1000° C., 1 min | 1000° C., 1 min | 35.2 | 3.22 | 1.54 | D | Comparative Example |
| 2 | i | 5 | 1000° C., 1 min | 1000° C., 1 min | 39.7 | 0.26 | 1.95 | A | Example |
| 3 | i | 10 | 1000° C., 1 min | 1000° C., 1 min | 40.1 | 0.20 | 1.98 | A | Example |
| 4 | j | 1.0 | 1000° C., 1 min | 1000° C., 1 min | 32.2 | 2.61 | 1.42 | C | Comparative Example |
| 5 | j | 4 | 1000° C., 1 min | 1000° C., 1 min | 36.5 | 0.22 | 1.54 | A | Example |
| 6 | k | 0.5 | 900° C., 1 min | 900° C., 1 min | 31.8 | 3.04 | 1.44 | D | Comparative Example |
| 7 | k | 4.4 | 900° C., 1 min | 900° C., 1 min | 35.2 | 0.35 | 1.59 | A | Example |
| 8 | l | 0.5 | 1000° C., 1 min | 1000° C., 1 min | 29.7 | 2.24 | 1.41 | D | Comparative Example |
| 9 | l | 8 | 1000° C., 1 min | 1000° C., 1 min | 34.5 | 0.14 | 1.55 | A | Example |
| 10 | m | 1.0 | 1050° C., 1 min | 1050° C., 1 min | 26.1 | 2.39 | 1.05 | D | Comparative Example |
| 11 | m | 6 | 1050° C., 1 min | 1050° C., 1 min | 30.4 | 0.44 | 1.22 | A | Example |
| 12 | n | 1.0 | 900° C., 2 min | 900° C., 1 min | 34.6 | 2.83 | 1.55 | D | Comparative Example |
| 13 | n | 10 | 900° C., 2 min | 900° C., 1 min | 40.5 | 0.16 | 2.06 | A | Example |
| 14 | n | 18 | 900° C., 2 min | 900° C., 1 min | 30.4 | 3.81 | 1.50 | D | Comparative Example |

TABLE 15

| Steel | Chemical component (mass %) | | | | | | | | | |
|---|---|---|---|---|---|---|---|---|---|---|
| No. | C | N | Si | Mn | P | S | Al | Cr | Ni | V |
| A | 0.063 | 0.033 | 0.27 | 0.60 | 0.030 | 0.006 | 0.001 | 16.3 | 0.33 | 0.061 |
| D | 0.051 | 0.044 | 0.31 | 0.55 | 0.034 | 0.005 | 0.002 | 17.7 | 0.20 | 0.031 |
| K | 0.022 | 0.029 | 0.25 | 0.35 | 0.026 | 0.006 | 0.002 | 13.2 | 0.07 | 0.062 |
| R | 0.036 | 0.055 | 0.23 | 0.25 | 0.021 | 0.004 | 0.001 | 16.2 | 0.11 | 0.047 |

TABLE 16

| | | Hot rolling | | Production Condition | | | | | |
|---|---|---|---|---|---|---|---|---|---|
| | | | | Pre-rolling condition | | Hot-rolled sheet annealing condition | | | |
| Steel sheet No. | Steel No. | Finishing delivery temperature ° C. | Thickness of hot-rolled sheet mm | Rolling temperature ° C. | Rolling reduction % | Heating rate * ° C./h | Retention temperature ° C. | Retention time h | Cooling rate ** ° C./h |
| 1 | A | 900 | 3.2 | RT | 6 | 13 | 880 | 8 | 7.8 |
| 2 | A | 900 | 3.2 | RT | 6 | 13 | 900 | 8 | 8.3 |
| 3 | A | 950 | 3.2 | RT | 2 | 12 | 860 | 8 | 7.2 |
| 4 | A | 950 | 3.2 | RT | 1 | 12 | 860 | 8 | 7.2 |
| 5 | A | 1000 | 3.2 | — | — | 10 | 800 | 8 | 5.6 |
| 6 | D | 950 | 3.2 | RT | 7 | 12 | 860 | 8 | 7.2 |
| 7 | D | 1000 | 4.0 | RT | 5 | 12 | 860 | 8 | 7.2 |
| 8 | K | 950 | 3.2 | RT | 1 | 12 | 860 | 8 | 7.2 |
| 9 | K | 950 | 3.2 | RT | 7 | 12 | 860 | 8 | 7.2 |
| 10 | R | 750 | 4.0 | RT | 7 | 14 | 930 | 2 | 10 |
| 11 | R | 900 | 4.0 | RT | 7 | 13 | 885 | 8 | 7.9 |

* Heating rate between 500° C. and the retention temperature.
** Mean cooling rate between the retention temperature and 600° C.
RT: Room Temp.

TABLE 17

| | | Hot-rolled annealed sheet | Cold-rolled annealed sheet | | Test Result | | | |
|---|---|---|---|---|---|---|---|---|
| Steel sheet No. | Steel No. | Maximum elongation index: e | AO $\mu m^2$ | Aspect ratio of coarse grain colony | Elongation $El_{mean}$ % | r value $r_{mean}$ | Ridging grade | Remarks |
| 1 | A | 2.8 | 154 | 3.2 | 34.8 | 1.48 | A | Example of this invention |
| 2 | A | 2.2 | 288 | 2.6 | 35.2 | 1.50 | A | Example of this invention |
| 3 | A | 4.9 | 70 | 3.8 | 32.8 | 1.33 | A | Example of this invention |
| 4 | A | 6.4 | 78 | 5.4 | 28.3 | 1.05 | C | Comparative Example |
| 5 | A | 10.5 | 72 | 12.4 | 26.7 | 0.98 | D | Comparative Example |
| 6 | D | 4.8 | 96 | 4.2 | 33.8 | 1.41 | A | Example of this invention |
| 7 | D | 4.0 | 102 | 3.7 | 34.0 | 1.42 | A | Example of this invention |
| 8 | K | 6.2 | 143 | 5.9 | 28.6 | 1.03 | C | Comparative Example |
| 9 | K | 3.5 | 160 | 3.0 | 34.4 | 1.45 | A | Example of this invention |
| 10 | R | 1.4 | 352 | 2.4 | 35.4 | 1.49 | A | Example of this invention |
| 11 | R | 2.0 | 208 | 3.5 | 34.6 | 1.46 | A | Example of this invention |

TABLE 18

(mass %)

| Steel | C | Si | Mn | P | S | Cr | N | Al | Mo | Ti | Nb | Cu | B |
|---|---|---|---|---|---|---|---|---|---|---|---|---|---|
| i | 0.008 | 0.15 | 0.30 | 0.030 | 0.006 | 17.0 | 0.0076 | 0.002 | — | — | 0.30 | — | 0.0005 |
| j | 0.009 | 0.26 | 0.46 | 0.030 | 0.006 | 16.1 | 0.0077 | 0.001 | — | — | 0.31 | 0.50 | 0.0006 |
| k | 0.008 | 0.06 | 0.15 | 0.033 | 0.005 | 17.8 | 0.0080 | 0.025 | 1.21 | 0.26 | — | — | 0.0010 |

TABLE 19

| Steel sheet No. | Steel No. | Production Condition: Thickness of hot-rolled sheet mm | Cold rolling reduction before annealing of hot-rolled sheet % | Continuous annealing condition for hot-rolled sheet | Finish annealing condition |
|---|---|---|---|---|---|
| 1 | i | 3.2 | 1.0 | 1000° C., 1 min | 1000° C., 1 min |
| 2 | i | 4.0 | 5 | 1000° C., 1 min | 1000° C., 1 min |
| 3 | i | 4.0 | 7.5 | 1000° C., 1 min | 1000° C., 1 min |
| 4 | i | 3.2 | 5 | 1000° C., 1 min | 1000° C., 1 min |
| 5 | i | 3.2 | 10 | 1000° C., 1 min | 1000° C., 1 min |
| 6 | j | 3.2 | 1 | 1000° C., 1 min | 1000° C., 1 min |
| 7 | j | 3.2 | 5 | 1000° C., 1 min | 1000° C., 1 min |
| 8 | k | 4.0 | 0.5 | 900° C., 1 min | 900° C., 1 min |
| 9 | k | 4.0 | 4.4 | 900° C., 1 min | 900° C., 1 min |

TABLE 20

| Steel sheet No. | Steel No. | Hot-rolled annealed sheet Maximum elongation index: e | Cold-rolled annealed sheet AO $\mu m^2$ | Aspect ratio of coarse grain colony | Test Result: Elongation $El_{mean}$ % | r value $r_{mean}$ | Ridging grade | Remarks |
|---|---|---|---|---|---|---|---|---|
| 1 | i | 5.3 | 164 | 5.6 | 35.2 | 1.54 | D | Comparative Example |
| 2 | i | 2.2 | 180 | 2.5 | 39.8 | 1.96 | A | Example of this invention |
| 3 | i | 1.5 | 176 | 1.6 | 40.0 | 1.94 | A | Example of this invention |
| 4 | i | 2.5 | 155 | 2.2 | 39.7 | 1.95 | A | Example of this invention |
| 5 | i | 1.8 | 157 | 2.3 | 40.1 | 1.98 | A | Example of this invention |
| 6 | j | 5.3 | 134 | 5.4 | 32.2 | 1.42 | C | Comparative Example |
| 7 | j | 2.4 | 128 | 2.4 | 36.5 | 1.54 | A | Example of this invention |
| 8 | k | 5.5 | 280 | 6.0 | 31.8 | 1.44 | D | Comparative Example |
| 9 | k | 2.6 | 358 | 2.4 | 35.2 | 1.59 | A | Example of this invention |

What is claimed is:

1. A method of producing a ferritic Cr-containing steel sheet having excellent ductility, formability, and anti-ridging property, the method comprising hot-rolling a steel raw material comprising, by mass %, about 0.001 to 0.12% of C, about 0.001 to 0.12% of N, about 0.0002 to 0.0030% of B, and about 9 to 32% of Cr to form a hot-rolled sheet, annealing the hot-rolled sheet, cold-rolling the hot-rolled sheet passed through the hot-rolled sheet annealing step, and finish annealing the cold-rolled sheet, wherein a pre-rolling step is performed comprising cold or warm rolling said sheet with a rolling reduction of about 2 to 15% between the hot-rolling step and the hot-rolled sheet annealing step.

2. A method according to claims 1, wherein said Cr-containing steel raw material further contains one or two of Mo and Cu in a total of about 0.5 to about 2.5%.

3. A method according to claim 1, wherein said Cr-containing steel raw material comprises a composition further comprising about 1.0% or less of Si, about 1.0% or less of Mn, about 1.0% or less of Ni, about 0.15% or less of V, about 0.05% or less of P, about 0.01% or less of S, the balance comprising Fe and incidental impurities.

4. A method of producing a ferritic Cr-containing steel sheet having excellent ductility, formability, and anti-ridging property, the method comprising hot-rolling a steel raw material comprising, by mass % , about 0.001 to 0.12% of C, about 0.001 to 0.12% of N, about 11 to 18% of Cr, and about 0.03% or less of Al to form a hot-rolled sheet, annealing the hot-rolled sheet, cold-rolling the hot-rolled sheet passed through the hot-rolled sheet annealing step, and finish annealing the cold-rolled sheet, wherein a pre-rolling step is performed comprising cold or warm rolling said sheet with a rolling reduction of about 2 to 15% between the hot-rolling step and the hot-rolled sheet annealing step, wherein said hot-rolled sheet annealing step comprises box annealing, and wherein said box annealing comprises retention at an annealing temperature for about 1 hour or more, and slow cooling to about 600° C. at a mean cooling rate of about 25° C./hr or less after said retention.

5. A method according to claim 4, wherein the annealing step is carried out at a temperature of about ($A_1$ transformation point+30)° C. to 1000° C., the $A_1$ transformation point being represented by the following equation:

$$A_1 \text{ transformation point}=35(Cr+1.72Mo+2.09Si+4.86Nb+8.29V+1.77Ti+21.4Al+40B-7.14C-8.0ON-3.28Ni-1.89Mn-0.5Cu)+310,$$

where the decimal contents are parts by mass %.

6. A method of producing a ferritic Cr-containing steel sheet having excellent ductility, formability, and anti-ridging property, the method comprising hot rolling a steel raw material comprising, by mass %, about 0.01 to 0.12% of C, about 0.01 to 0.12% of N, about 0.0002 to 0.0030% of B, about 11 to 18% of Cr, and about 0.03% or less of Al to form a hot-rolled sheet, annealing the hot-rolled sheet, cold-rolling the hot-rolled sheet passed through the hot-rolled sheet annealing step to form a cold-rolled sheet, and finish annealing the cold-rolled sheet, wherein a pre-rolling step is performed by cold or warm rolling said sheet with a rolling reduction of about 2 to 15% between the hot-rolling step and the hot-rolled sheet annealing step, and wherein said hot-rolled sheet annealing step comprises box annealing.

7. A method of producing a ferritic Cr-containing steel sheet having excellent ductility, formability, and anti-ridging property, comprising hot-rolling a steel raw material containing, by mass % , about 0.005 to 0.12% of C, about 0.005 to 0.12% of N, about 11 to 18% of Cr, about 0.0002 to 0.0030% of B, and about 0.03% or less of Al to form a hot-rolled sheet, annealing the hot-rolled sheet, cold-rolling the hot-rolled sheet passed through the hot-rolled sheet annealing step to form a cold-rolled sheet, and finish annealing the cold-rolled sheet, wherein a pre-rolling step is performed by cold or warm rolling with a rolling reduction of about 2 to 15% between the hot-rolling step and the hot-rolled sheet annealing step, and wherein said hot-rolled sheet annealing step comprises box annealing.

8. A method of producing a ferritic Cr-containing steel sheet having excellent ductility, formability, and anti-ridging property, comprising hot-rolling a steel raw material comprising, by mass %, about 0.001 to 0.02% of C, about 0.001 to 0.02% of N, about 9 to 32% of Cr, about 0.30% or less of Al, about 0.0002 to 0.0030% of B, and one or both of about 0.05 to 0.50% of Ti and about 0.05 to 0.50% of Nb to form a hot-rolled sheet, annealing the hot-rolled sheet, cold-rolling the hot-rolled sheet passed through the hot-rolled sheet annealing step to form a cold-rolled sheet, and finish annealing the cold-rolled sheet, wherein a pre-rolling step is performed by cold or warm rolling with a rolling reduction of about 2 to 15% between the hot-rolling step and the hot-rolled sheet annealing step, and wherein said hot-rolled sheet annealing step comprises continuous annealing.

9. A method according to claim 8, wherein said Cr-containing steel raw material further comprises one or both of Mo and Cu in a total amount by mass of about 0.5 to 2.5%.

10. A method according to claim 8, wherein said Cr-containing steel raw material further comprises about 1.0% or less of Si, about 1.0% or less of Mn, about 1.0% or less of Ni, about 0.15% or less of V, about 0.05% or less of P, about 0.01% or less of S, the balance composed of Fe and incidental impurities.

11. A method according to claim 1, wherein said hot rolled sheet is delivered for finishing, and wherein the finishing delivery temperature of said hot rolling is about 850° C. or less.

* * * * *

UNITED STATES PATENT AND TRADEMARK OFFICE

CERTIFICATE OF CORRECTION

PATENT NO. : 6,413,332 B1
DATED : July 2, 2002
INVENTOR(S) : Ota et al.

It is certified that error appears in the above-identified patent and that said Letters Patent is hereby corrected as shown below:

Column 34,
Line 57, please change “8.0ON” to -- 8.0N --, and “0.5Cu” to -- 0.51Cu --.

Signed and Sealed this

Twenty-fourth Day of December, 2002

JAMES E. ROGAN
*Director of the United States Patent and Trademark Office*